US011408044B2

(12) United States Patent
Minami et al.

(10) Patent No.: US 11,408,044 B2
(45) Date of Patent: Aug. 9, 2022

(54) HIGH-STRENGTH STEEL SHEET AND METHOD FOR PRODUCING THE SAME

(71) Applicant: JFE STEEL CORPORATION, Tokyo (JP)

(72) Inventors: Hidekazu Minami, Tokyo (JP); Fusae Shiimori, Tokyo (JP); Shinjiro Kaneko, Tokyo (JP); Takashi Kobayashi, Tokyo (JP); Yuji Tanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 510 days.

(21) Appl. No.: 16/485,083

(22) PCT Filed: Feb. 9, 2018

(86) PCT No.: PCT/JP2018/004513

§ 371 (c)(1),
(2) Date: Aug. 9, 2019

(87) PCT Pub. No.: WO2018/147400

PCT Pub. Date: Aug. 16, 2018

(65) Prior Publication Data

US 2020/0040420 A1 Feb. 6, 2020

(30) Foreign Application Priority Data

Feb. 13, 2017 (JP) ..... JP2017-023703
Sep. 29, 2017 (JP) ..... JP2017-191328

(51) Int. Cl.

| | |
|---|---|
| ***C21D 9/46*** | (2006.01) |
| ***C21D 8/02*** | (2006.01) |
| ***C21D 6/00*** | (2006.01) |
| ***C21D 1/26*** | (2006.01) |
| ***C22C 38/24*** | (2006.01) |
| ***C22C 38/60*** | (2006.01) |
| ***C22C 38/16*** | (2006.01) |
| ***C22C 38/14*** | (2006.01) |
| ***C22C 38/12*** | (2006.01) |
| ***C22C 38/10*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |

(52) U.S. Cl.

CPC ..... *C21D 9/46* (2013.01); *C21D 1/26* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/24* (2013.01); *C22C 38/60* (2013.01); *C21D 2211/001* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 5,328,528 | A | 7/1994 | Chen | |
| 2006/0130937 | A1 | 6/2006 | Ikeda et al. | |
| 2012/0012231 | A1 | 1/2012 | Murakami et al. | |
| 2014/0377584 | A1* | 12/2014 | Hasegawa | C22C 38/002 148/533 |
| 2015/0086808 | A1 | 3/2015 | Kasuya et al. | |
| 2016/0312323 | A1 | 10/2016 | Rana et al. | |

FOREIGN PATENT DOCUMENTS

| | | | |
|---|---|---|---|
| CN | 101768695 | A | 7/2010 |
| CN | 102884218 | A | 1/2013 |
| CN | 103987868 | A | 8/2014 |
| CN | 104508163 | A | 4/2015 |

(Continued)

OTHER PUBLICATIONS

Dec. 1, 2020 Office Action issued in Chinese Patent Application No. 201880011427.8.

(Continued)

*Primary Examiner* — Anthony M Liang

(74) *Attorney, Agent, or Firm* — Oliff PLC

(57) ABSTRACT

There is provided a high-strength steel sheet and a method for producing the same. The high-strength steel sheet has a specified chemical composition and a steel microstructure including, by area fraction, 75.0% or more tempered martensite, 1.0% or more and 20.0% or less fresh martensite, and 5.0% or more and 20.0% or less retained austenite. A hardness ratio of the fresh martensite to the tempered martensite is 1.5 or more and 3.0 or less, the ratio of the maximum KAM value in the tempered martensite in the vicinity of the heterophase interface between the tempered martensite and the fresh martensite to the average KAM value in the tempered martensite is 1.5 or more and 30.0 or less, and the average of ratios of grain sizes of prior austenite grains in the rolling direction to those in the thickness direction is 2.0 or less.

20 Claims, No Drawings

(56) References Cited

FOREIGN PATENT DOCUMENTS

| | | | |
|---|---|---|---|
| CN | 104726767 | A | 6/2015 |
| CN | 106244924 | A | 12/2016 |
| EP | 2 436 794 | A1 | 4/2012 |
| EP | 2 546 382 | A1 | 1/2013 |
| EP | 2 757 171 | A1 | 7/2014 |
| EP | 2 762 588 | A1 | 8/2014 |
| EP | 2762583 | A1 | 8/2014 |
| EP | 2 881 481 | A1 | 6/2015 |
| EP | 3 012 339 | A1 | 4/2016 |
| EP | 3 101 147 | A1 | 12/2016 |
| EP | 3 128 023 | A1 | 2/2017 |
| EP | 3 266 894 | A1 | 1/2018 |
| JP | 2010-255090 | A | 11/2010 |
| JP | 2010-255091 | A | 11/2010 |
| JP | 2011-080106 | A | 4/2011 |
| JP | 5457840 | B2 | 4/2014 |
| JP | 2014-80665 | A | 5/2014 |
| JP | 2015-34327 | A | 2/2015 |
| JP | 2015-200012 | A | 11/2015 |
| JP | 2016-008310 | A | 1/2016 |
| JP | 5862051 | B2 | 2/2016 |
| JP | 5884210 | B1 | 3/2016 |
| JP | 5896086 | B1 | 3/2016 |
| KR | 20140052070 | A | 5/2014 |
| KR | 20160047465 | A | 5/2016 |
| WO | 2016/139876 | A1 | 9/2016 |

OTHER PUBLICATIONS

Dec. 17, 2020 Notice of Allowance issued in Korean Patent Application No. 10-2019-7023741.

May 15, 2018 International Search Report issued in International Patent Application No. PCT/JP2018/004513.

Nov. 26, 2019 Extended Search Report issued in European Patent Application No. 18750760.3.

* cited by examiner

HIGH-STRENGTH STEEL SHEET AND METHOD FOR PRODUCING THE SAME

TECHNICAL FIELD

This application relates to a high-strength steel sheet mainly suitable for automotive structural members and a method for producing the high-strength steel sheet.

BACKGROUND

With increasing concern about environmental problems, $CO_2$ emission regulations have recently been tightened. In the field of automobiles, reductions in the weight of automobile bodies for increasing fuel efficiency are issues to be addressed. Thus, progress has been made in reducing the thickness of automobile parts by using a high-strength steel sheet for automobile parts. In particular, there is a growing trend toward using a steel sheet having a tensile strength (TS) of 1,180 MPa or more.

High-strength steel sheets used for structural members and reinforcing members of automobiles are required to have good workability. In particular, a high-strength steel sheet used for parts having complex shapes is required not only to have characteristics such as good ductility (hereinafter, also referred to as "elongation") or good stretch-flangeability (hereinafter, also referred to as "hole expansion formability") but also to have both good ductility and good stretch-flangeability. Additionally, automobile parts such as structural members and reinforcing members are required to have good collision energy absorption characteristics. The control of the yield ratio (YR=YS/TS) of the steel sheet serving as a material is effective in improving the collision energy absorption characteristics of automobile parts. The control of the yield ratio (YR) of the high-strength steel sheet enables the reduction of springback after forming the steel sheet into a shape and an increase in collision energy absorption at the time of collision.

An increase in the strength of a steel sheet and a reduction in thickness significantly degrade the shape fixability of the steel sheet. To address this, it is widely practiced to predict shape change after release from a mold in press forming and to design the mold with consideration for the amount of shape change. In the case where YS of the steel sheet varies greatly, however, the amount of shape change when the amount of shape change predicted is assumed to be constant deviates markedly from a target, thereby inducing a shape defect. The resulting steel sheet defective in shape after press forming needs to be individually corrected by sheet-metal working. This significantly decreases mass production efficiency. Accordingly, variations in the YS of a steel sheet are required to be minimized.

To deal with these requests, for example, Patent Literature 1 discloses a high-strength steel sheet having a component composition that contains, by mass, C: 0.12% to 0.22%, Si: 0.8% to 1.8%, Mn: 1.8% to 2.8%, P: 0.020% or less, S: 0.0040% or less, Al: 0.005% to 0.08%, N: 0.008% or less, Ti: 0.001% to 0.040%, B: 0.0001% to 0.0020%, and Ca: 0.0001% to 0.0020%, the balance being Fe and incidental impurities, the high-strength steel sheet having a microstructure that contains 50% to 70% by area of ferrite and bainite phases, in total, having an average grain size of 1 to 3 μm, 25% to 45% by area of a tempered martensite having an average grain size of 1 to 3 μm, and 2% to 10% by area of a retained austenite phase, the high-strength steel sheet having a tensile strength of 1,180 MPa or more, good elongation, stretch-flangeability, and bendability.

Patent Literature 2 discloses a high-strength steel sheet having a component composition that contains, by mass, C: 0.15% to 0.27%, Si: 0.8% to 2.4%, Mn: 2.3% to 3.5%, P: 0.08% or less, S: 0.005% or less, Al: 0.01% to 0.08%, and N: 0.010% or less, the balance being Fe and incidental impurities, the high-strength steel sheet having a microstructure that contains ferrite having an average grain size of 5 μm or less and that contains a ferrite volume fraction of 3% to 20%, a retained austenite volume fraction of 5% to 20%, a martensite volume fraction of 5% to 20%, and the remainder containing bainite and/or tempered martensite, in which the total number of the retained austenite, the martensite, or a mixture phase thereof having a grain size of 2 μm or less is 150 or more per 2,000 $\mu m^2$ of a section of the steel sheet in the thickness direction parallel to the rolling direction of the steel sheet, and the high-strength steel sheet has a tensile strength of 1,180 MPa or more, good elongation, and good stretch-flangeability while a high yield ratio is achieved.

Patent Literature 3 discloses a high-strength galvanized steel sheet having a component composition that contains, by mass, C: 0.120% or more and 0.180% or less, Si: 0.01% or more and 1.00% or less, Mn: 2.20% or more and 3.50% or less, P: 0.001% or more and 0.050% or less, S: 0.010% or less, sol. Al: 0.005% or more and 0.100% or less, N: 0.0001% or more and 0.0060% or less, Nb: 0.010% or more and 0.100% or less, and Ti: 0.010% or more and 0.100% or less, the balance being Fe and incidental impurities, the steel sheet having a microstructure that contains 10% or more and 60% or less by area ferrite and 40% or more and 90% or less by area martensite, the steel sheet having a tensile strength of 1,180 MPa or more, good surface appearance, and improved stretch-flangeability, the material thereof having a weak dependence on an annealing temperature.

Patent Literature 4 discloses a high-strength cold-rolled steel sheet containing, by mass, C: 0.13% to 0.25%, Si: 1.2% to 2.2%, Mn: 2.0% to 3.2%, P: 0.08% or less, S: 0.005% or less, Al: 0.01% to 0.08%, N: 0.008% or less, and Ti: 0.055% to 0.130%, the balance being Fe and incidental impurities, the steel sheet having a microstructure that contains a ferrite volume fraction of 2% to 15%, the ferrite having an average grain size of 2 μm or less, a retained austenite volume fraction of 5% to 20%, the retained austenite having an average grain size of 0.3% to 2.0 μm, a martensite volume fraction of 10% or less (including 0%), the martensite having an average grain size of 2 μm or less, and the remainder containing bainite and tempered martensite, the average grain size of the bainite and the tempered martensite being 5 μm or less, the steel sheet having a tensile strength of 1,180 MPa or more, good elongation, good hole expansion formability, good delayed fracture properties, and high yield ratio.

CITATION LIST

Patent Literature

PTL 1: Japanese Unexamined Patent Application Publication No. 2014-80665

PTL 2: Japanese Unexamined Patent Application Publication No. 2015-34327

PTL 3: Japanese Patent No. 5884210

PTL 4: Japanese Patent No. 5896086

SUMMARY

Technical Problem

In the techniques described in Patent Literatures 1 to 4, improvements in workability, in particular, elongation, stretch-flangeability, and bendability are disclosed. In any of the literatures, however, the in-plane anisotropy of a yield stress (YS) is not considered.

In the technique described in Patent Literature 1, as disclosed in Tables 1 to 3, annealing needs to be performed three times in order to achieve a tensile strength of 1,180 MPa or more, sufficient ductility, sufficient stretch-flangeability. In the technique described in Patent Literature 2, in order to achieve both good ductility and good stretch-flangeability, ferrite needs to be contained in an amount of 3% to 20% by volume, and annealing needs to be performed twice after cold rolling. In the technique described in Patent Literature 3, the balance between a tensile strength of 1,180 MPa or more and TS×El is insufficient. In the technique described in Patent Literature 4, in order to achieve good ductility and good stretch-flangeability while a tensile strength of 1,180 MPa or more is achieved, ferrite needs to have an average grain size of 2 μm or less, and Ti, which is expensive, needs to be contained.

In light of the circumstances described above, the disclosed embodiments aim to provide a high-strength steel sheet particularly having a tensile strength (TS) of 1,180 MPa or more, good ductility, good stretch-flangeability, good controllability of a yield stress (YS), and good in-plane anisotropy, and a method for producing the high-strength steel sheet.

Solution to Problem

To overcome the foregoing problems, the inventors have conducted intensive studies to obtain a high-strength steel sheet having a tensile strength of 1,180 MPa or more, good ductility, good stretch-flangeability, the controllability of a yield stress (YS), and good in-plane anisotropy, and a method for producing the high-strength steel sheet and have found the following.

(1) The presence of retained austenite improves the ductility, (2) the use of a steel microstructure mainly containing tempered martensite improves the stretch-flangeability, (3) by controlling the hardness ratio of fresh martensite to the tempered martensite and controlling the ratio of the maximum KAM value in the tempered martensite in the vicinity of a heterophase interface between the tempered martensite and the fresh martensite to the average KAM value in the tempered martensite, the controllability of the yield stress (YS) is improved, in other words, YR can be widely controlled, and (4) by controlling the ratio of the grain size of prior austenite grains in the rolling direction to that in the thickness direction, the in-plane anisotropy of the yield stress (YS) can be reduced.

These findings have led to the completion of the disclosed embodiments. The gist of the disclosed embodiments is described below.

[1] A high-strength steel sheet has a component composition containing, by mass, C: 0.08% or more and 0.35% or less, Si: 0.50% or more and 2.50% or less, Mn: 2.00% or more and 3.50% or less, P: 0.001% or more and 0.100% or less, S: 0.0200% or less, Al: 0.010% or more and 1.000% or less, and N: 0.0005% or more and 0.0100% or less, the balance being Fe and incidental impurities; and a steel microstructure containing, by area, 75.0% or more tempered martensite, 1.0% or more and 20.0% or less fresh martensite, and 5.0% or more and 20.0% or less retained austenite, in which a hardness ratio of the fresh martensite to the tempered martensite is 1.5 or more and 3.0 or less, a ratio of a maximum KAM value in the tempered martensite in the vicinity of a heterophase interface between the tempered martensite and the fresh martensite to the average KAM value in the tempered martensite is 1.5 or more and 30.0 or less, and an average of ratios of grain sizes of prior austenite grains in the rolling direction to those in the thickness direction is 2.0 or less.

[2] The high-strength steel sheet according to [1], the steel microstructure further contains, by area, 10.0% or less bainite, and the retained austenite has an average grain size of 0.2 μm or more and 5.0 μm or less.

[3] The high-strength steel sheet according to [1] or [2], the component composition further contains, by mass, at least one selected from Ti: 0.001% or more and 0.100% or less, Nb: 0.001% or more and 0.100% or less, V: 0.001% or more and 0.100% or less, B: 0.0001% or more and 0.0100% or less, Mo: 0.01% or more and 0.50% or less, Cr: 0.01% or more and 1.00% or less, Cu: 0.01% or more and 1.00% or less, Ni: 0.01% or more and 0.50% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

[4] The high-strength steel sheet according to any of [1] to [3] further includes a coated layer on a surface of the steel sheet.

[5] A method for producing the high-strength steel sheet according to any of [1] to [3] includes, in sequence, heating steel, performing hot rolling at a finish rolling entry temperature of 1,020° C. or higher and 1,180° C. or lower and a finish rolling delivery temperature of 800° C. or higher and 1,000° C. or lower, performing coiling at a coiling temperature of 600° C. or lower, performing cold rolling, and performing annealing, in which letting a temperature defined by formula (1) be temperature T1 (° C.) and letting a temperature defined by formula (2) be temperature T2 (° C.), the annealing includes, in sequence, retaining heat at a heating temperature equal to or higher than temperature T1 for 10 s or more, performing cooling to a cooling stop temperature of 220° C. or higher and ((220° C.+temperature T2)/2) or lower, performing reheating from the cooling stop temperature to a reheating temperature of A or higher and 560° C. or lower (where A is a freely-selected temperature (° C.) that satisfies (temperature T2+20° C.)≤A≤530° C.)) at an average heating rate of 10° C./s or more, and performing holding at a holding temperature (A) of (temperature T2+20° C.) or higher and 530° C. or lower for 10 s or more, $$\text{in which temperature } T1(^\circ\text{C.}) = 960 - 203\times[\%\,C]^{1/2} + 45\times[\%\,Si] - 30\times[\%\,Mn] + 150\times[\%\,Al] - 20\times[\%\,Cu] + 11\times[\%\,Cr] + 400\times[\%\,Ti] \quad (1)$$

where [% X] indicates the component element X content (% by mass) of steel and is 0 if X is not contained, and $$\text{temperature } T2(^\circ\text{C.}) = 560 - 566\times[\%\,C] - 150\times[\%\,C]\times[\%\,Mn] - 7.5\times[\%\,Si] + 15\times[\%\,Cr] - 67.6\times[\%\,C]\times[\%\,Cr] \quad (2)$$

where [% X] indicates the component element X content (% by mass) of steel and is 0 if X is not contained.

[6] The method for producing the high-strength steel sheet according to [5], in the hot rolling, the rolling reduction in a pass before a final pass of the finish rolling is 15% or more and 25% or less.

[7] The method for producing the high-strength steel sheet according to [5] or [6], a heat treatment is performed after the coiling and before the cold rolling, the heat treatment including performing cooling from the coiling temperature to 200° C. or lower, performing reheating, and performing holding in the temperature range of 450° C. to 650° C. for 900 s or more.

[8] The method for producing the high-strength steel sheet according to any one of [5] to [7], a coating treatment is performed after the annealing.

In the disclosed embodiments, the "high-strength steel sheet" refers to a steel sheet having a tensile strength (TS) of 1,180 MPa or more and includes a cold-rolled steel sheet and a steel sheet obtained by subjecting a cold-rolled steel sheet to surface treatment such as coating treatment or coating alloying treatment. In the disclosed embodiments, "good ductility", i.e., "good total elongation (El)" indicates that the value of TS×El is 16,500 MPa·% or more. In the disclosed embodiments, "good stretch-flangeability" indicates that the value of a hole expansion ratio (λ), which serves as an index of the stretch-flangeability, is 30% or more. In the disclosed embodiments, "good controllability of the yield stress (YS)" indicates that the value of a yield ratio (YR), which serves as an index of the controllability of YS, is 65% or more and 95% or less. YR is determined by formula (3):

$$YR=YS/TS \quad (3)$$

In the disclosed embodiments, "good in-plane anisotropy of the yield stress (YS)" indicates that the value of |ΔYS|, which serves as an index of the in-plane anisotropy of YS, is 50 MPa or less. |ΔYS| can be determined by formula (4):

$$|\Delta YS|=(YS_L-2\times YS_D+YS_C)/2 \quad (4)$$

where $YS_L$, $YS_D$, and $YS_C$ are values of YS measured by performing a tensile test at a cross-head speed of 10 mm/min in accordance with the description of JIS Z 2241(2011) using JIS No. 5 test pieces taken in three directions: the rolling direction (L-direction) of the steel sheet, a direction (D-direction) forming an angle of 45° with respect to the rolling direction of the steel sheet, and a direction (C-direction) perpendicular to the rolling direction of the steel sheet.

Advantageous Effects

According to the disclosed embodiments, the high-strength steel sheet having a tensile strength of 1,180 MPa or more, good ductility, good stretch-flangeability, good controllability of the yield stress, and good in-plane anisotropy is obtained. The use of the high-strength steel sheet, obtained by the production method of the disclosed embodiments, for, for example, automotive structural members reduces the weight of automobile bodies to contribute greatly to an improvement in fuel economy; thus, the high-strength steel sheet has a very high industrial utility value.

DETAILED DESCRIPTION

The disclosed embodiments will be described in detail below.

The component composition of a high-strength steel sheet of the disclosed embodiments and the reason for the limitation will be described below. In the following description, "%" that expresses the component composition of steel refers to "% by mass" unless otherwise specified.

C: 0.08% or more and 0.35% or less

C is one of the important basic components of steel. In particular, in the disclosed embodiments, C is an important element that affects fractions (area percentages) of tempered martensite and fresh martensite (as-quenched martensite) after annealing and the fraction (area percentage) of retained austenite. The mechanical characteristics such as the strength of the resulting steel sheet vary greatly, depending on the fractions (area percentages) and the hardness of the tempered martensite and the fresh martensite and strain introduced around them. The ductility varies greatly, depending on the fraction (area percentage) of the retained austenite. A C content of less than 0.08% results in a decrease in the hardness of the tempered martensite, thereby making it difficult to ensure desired strength. Additionally, the fraction of the retained austenite is decreased to decrease the ductility of the steel sheet. Furthermore, the hardness ratio of the fresh martensite to the tempered martensite cannot be controlled, and YR, which serves as an index of the controllability of YS, cannot be controlled within a desired range. A C content of more than 0.35% results in an increase in the hardness of the tempered martensite, thereby decreasing YR, which serves as an index of the controllability of YS, and decreasing X. Accordingly, the C content is 0.08% or more and 0.35% or less, preferably 0.12% or more, preferably 0.30% or less, more preferably 0.15% or more, more preferably 0.26% or less, even more preferably 0.16% or more, even more preferably 0.23% or less.

Si: 0.50% or more and 2.50% or less

Si is an important element to improve the ductility of the steel sheet by inhibiting the formation of carbide and promoting the formation of the retained austenite. Additionally, Si is also effective in inhibiting the formation of carbide due to the decomposition of the retained austenite. At a Si content of less than 0.50%, a desired fraction of the retained austenite cannot be ensured, thereby decreasing the ductility of the steel sheet. Additionally, a desired fraction of the fresh martensite cannot be ensured, thus failing to control YR, which serves as an index of the controllability of YS, within a desired range. A Si content of more than 2.50% results in an increase in the hardness of the tempered martensite, thereby decreasing YR, which serves as an index of the controllability YS, and decreasing X at the same time. Accordingly, the Si content is 0.50% or more and 2.50% or less, preferably 0.80% or more, preferably 2.00% or less, more preferably 1.00% or more, more preferably 1.80% or less, even more preferably 1.20% or more, even more preferably 1.70% or less.

Mn: 2.00% or more and 3.50% or less

Mn is effective in ensuring the strength of the steel sheet. Additionally, Mn has the effect of inhibiting the formation of pearlite and bainite during cooling in annealing and thus facilitates transformation from austenite to martensite. A Mn content of less than 2.00% results in the formation of ferrite, pearlite, or bainite during the cooling in the annealing. This fails to ensure desired fractions of the tempered martensite and the fresh martensite, thereby decreasing TS. A Mn content of more than 3.50% results in marked Mn segregation in the thickness direction and the formation of elongated austenite in the rolling direction during annealing. This increases the average aspect ratio of prior austenite grains after the annealing (average of ratios of the grain size of the prior austenite grains in the rolling direction to those in the thickness direction) to increase |ΔYS|, which serves as an index of the in-plane anisotropy of YS. Additionally, a decrease in castability is caused. Furthermore, the spot weldability and the coating properties are degraded. Accordingly, the Mn content is 2.00% or more and 3.50% or less, preferably 2.30% or more, preferably 3.20% or less, more preferably 2.50% or more, more preferably 3.00% or less.

P: 0.001% or more and 0.100% or less

P is an element that has a solid-solution strengthening effect and can be contained, depending on desired strength. To provide the effects, the P content needs to be 0.001% or more. At a P content of more than 0.100%, P segregates at grain boundaries of prior austenite to embrittle the grain boundaries, thereby decreasing the local elongation to decrease the total elongation (ductility). The stretch-flangeability is also deteriorated. Furthermore, the weldability is degraded. Additionally, when a galvanized coating is subjected to alloying treatment, the alloying rate is markedly slowed to degrade the coating quality. Accordingly, the P content is 0.001% or more and 0.100% or less, preferably 0.005% or more, preferably 0.050% or less.

S: 0.0200% or less

S segregates at grain boundaries to embrittle steel during hot rolling and is present in the form of a sulfide to decrease the local deformability, the ductility, and the stretch-flangeability. Thus, the S content needs to be 0.0200% or less. Accordingly, the S content is 0.0200% or less, preferably 0.0050% or less. The lower limit of the S content is not particularly limited. However, because of the limitation of the production technology, the S content is preferably 0.0001% or more.

Al: 0.010% or more and 1.000% or less

Al is an element that can inhibit the formation of carbide during the cooling step in the annealing to promote the formation of martensite and is effective in ensuring the strength of the steel sheet. To provide the effects, the Al content needs to be 0.010% or more. An Al content of more than 1.000% results in a large number of inclusions in the steel sheet. This decreases the local deformability, thereby decreasing the ductility. Accordingly, the Al content is 0.010% or more and 1.000% or less, preferably 0.020% or more, preferably 0.500% or less.

N: 0.0005% or more and 0.0100% or less

N binds to Al to form AlN. When B is contained, N is formed into BN. A high N content results in the formation of a large amount of coarse nitride. This decreases the local deformability, thereby decreasing the ductility. Furthermore, the stretch-flangeability is deteriorated. Thus, the N content is 0.0100% or less. Because of the limitation of the production technology, the N content needs to be 0.0005% or more. Accordingly, the N content is 0.0005% or more and 0.0100% or less, preferably 0.0010% or more, preferably 0.0070% or less, more preferably 0.0015% or more, more preferably 0.0050% or less.

The balance is iron (Fe) and incidental impurities. However, O may be contained in an amount of 0.0100% or less to the extent that the advantageous effects of the disclosed embodiments are not impaired.

The steel sheet of the disclosed embodiments contains these essential elements described above and thus has the intended characteristics. In addition to the essential elements, the following elements can be contained as needed.

At Least One Selected from Ti: 0.001% or more and 0.100% or less, Nb: 0.001% or more and 0.100% or less, V: 0.001% or more and 0.100% or less, B: 0.0001% or more and 0.0100% or less, Mo: 0.01% or more and 0.50% or less, Cr: 0.01% or more and 1.00% or less, Cu: 0.01% or more and 1.00% or less, Ni: 0.01% or more and 0.50% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, REM: 0.0001% or more and 0.0200% or less Ti, Nb, and V form fine carbides, nitrides, or carbonitrides during the hot rolling or annealing to increase the strength of the steel sheet. To provide the effect, each of the Ti content, the Nb content, and the V content needs to be 0.001% or more. If each of the Ti content, the Nb content, and the V content is more than 0.100%, large amounts of coarse carbides, nitrides, or carbonitrides are precipitated in the substructure of the tempered martensite, which is a matrix phase, or at grain boundaries of prior austenite, thereby decreasing the local deformability to decrease the ductility and the stretch-flangeability. Accordingly, when Ti, Nb, and V are contained, each of the Ti content, the Nb content, and the V content is preferably 0.001% or more and 0.100% or less, more preferably 0.005% or more and 0.050% or less.

B is an element that can improve the hardenability without decreasing the martensitic transformation start temperature and can inhibit the formation of pearlite and bainite during the cooling in the annealing to facilitate the transformation from austenite to martensite. To provide the effects, the B content needs to be 0.0001% or more. A B content of more than 0.0100% results in the formation of cracks in the steel sheet during the hot rolling, thereby greatly decreasing the ductility. Furthermore, the stretch-flangeability is also decreased. Accordingly, when B is contained, the B content is preferably 0.0001% or more and 0.0100% or less, more preferably 0.0003% or more, more preferably 0.0050% or less, even more preferably 0.0005% or more, even more preferably 0.0030 or less.

Mo is an element that can improve the hardenability. Additionally, Mo is an element effective in forming tempered martensite and fresh martensite. The effects are provided at a Mo content of 0.01% or more. However, even if the Mo content is more than 0.50%, it is difficult to further provide the effects. Additionally, for example, inclusions are increased to cause defects and so forth on the surfaces and in the steel sheet, thereby greatly decreasing the ductility. Accordingly, when Mo is contained, the Mo content is preferably 0.01% or more and 0.50% or less, more preferably 0.02% or more, more preferably 0.35% or less, even more preferably 0.03% or more, even more preferably 0.25% or less.

Cr and Cu serve as solid-solution strengthening elements and, in addition, stabilize austenite to facilitate the formation of tempered martensite and fresh martensite during the cooling in the annealing, during the heating, and during a cooling step in cooling treatment of a cold-rolled steel sheet. To provide the effects, each of the Cr content and the Cu content needs to be 0.01% or more. If each of the Cr content and the Cu content is more than 1.00%, cracking of surface layers may occur during the hot rolling. Additionally, for example, inclusions are increased to cause defects and so forth on the surfaces and in the steel sheet, thereby greatly decreasing the ductility. Furthermore, the stretch-flangeability is also decreased. Accordingly, when Cr and Cu are contained, each of the Cr content and the Cu content is preferably 0.01% or more and 1.00% or less, more preferably 0.05% or more, more preferably 0.80% or less.

Ni is an element that contributes to an increase in strength owing to solid-solution strengthening and transformation strengthening. To provide the effect, Ni needs to be contained in an amount of 0.01% or more. An excessive Ni content may cause the surface layers to be cracked during the hot rolling and increases, for example, inclusions to cause defects and so forth on the surfaces and in the steel sheet, thereby greatly decreasing the ductility. Furthermore, the stretch-flangeability is also decreased. Accordingly, when Ni is contained, the Ni content is preferably 0.01% or more and 0.50% or less, more preferably 0.05% or more, more preferably 0.40% or less.

As is an element effective in improving the corrosion resistance. To provide the effect, As needs to be contained in an amount of 0.001% or more. An excessive As content results in the promotion of hot shortness and the increase of, for example, inclusions. This causes defects and so forth on the surfaces and in the steel sheet, thereby greatly decreasing the ductility. Furthermore, the stretch-flangeability is also decreased. Accordingly, when As is contained, the As content is preferably 0.001% or more and 0.500% or less, more preferably 0.003% or more, more preferably 0.300% or less.

Sb and Sn may be contained as needed from the viewpoint of inhibiting decarbonization in regions extending from the surfaces of the steel sheet to positions several tens of micrometers from the surfaces in the thickness direction, the decarbonization being caused by nitridation or oxidation of the surfaces of the steel sheet. The inhibition of the nitridation and the oxidation prevents a decrease in the amount of martensite formed on the surfaces of the steel sheet and is thus effective in ensuring the strength of the steel sheet. To provide the effect, each of the Sb content and the Sn content needs to be 0.001% or more. If each of Sb and Sn is excessively contained in an amount of more than 0.200%, the ductility is decreased. Accordingly, when Sb and Sn are contained, each of the Sb content and the Sn content is preferably 0.001% or more and 0.200% or less, more preferably 0.002% or more, more preferably 0.150% or less.

Ta is an element that forms alloy carbides and alloy carbonitrides to contribute to an increase in strength, as well as Ti and Nb. Additionally, Ta is partially dissolved in Nb carbide and Nb carbonitride to form a complex precipitate such as (Nb, Ta)(C, N) and thus to significantly inhibit the coarsening of precipitates, so that Ta is seemingly effective in stabilizing the percentage contribution to an improvement in the strength of the steel sheet through precipitation strengthening. Thus, Ta is preferably contained as needed. The precipitation-stabilizing effect is provided at a Ta content of 0.001% or more. Even if Ta is excessively contained, the precipitation-stabilizing effect is saturated. Furthermore, for example, the inclusions are increased to cause defects and so forth on the surfaces and in the steel sheet, thereby greatly decreasing the ductility. Furthermore, the stretch-flangeability is also decreased. Accordingly, when Ta is contained, the Ta content is preferably 0.001% or more and 0.100% or less, more preferably 0.002% or more, more preferably 0.080% or less.

Ca and Mg are elements that are used for deoxidation and that are effective in spheroidizing the shape of sulfides to improve the adverse effect of sulfides on the ductility, in particular, the local deformability. To provide the effects, each of the Ca content and the Mg content needs to be 0.0001% or more. If each of the Ca content and the Mg content is more than 0.0200%, for example, inclusions are increased to cause defects and so forth on the surfaces and in the steel sheet, thereby greatly decreasing the ductility. Furthermore, the stretch-flangeability is also decreased. Accordingly, when Ca and Mg are contained, each of the Ca content and the Mg content is preferably 0.0001% or more and 0.0200% or less, more preferably 0.0002% or more, more preferably 0.0100% or less.

Each of Zn, Co, and Zr is an element effective in spheroidizing the shape of sulfides to improve the adverse effect of sulfides on the local deformability and the stretch-flangeability. To provide the effects, each of the Zn content, the Co content, and the Zr content needs to be 0.001% or more. If each of the Zn content, the Co content, and the Zr content is more than 0.020%, for example, inclusions are increased to cause defects and so forth on the surfaces and the inside, thereby decreasing the ductility and the stretch-flangeability. Accordingly, when Zn, Co, and Zr are contained, each of the Zn content, the Co content, and the Zr content is preferably 0.001% or more and 0.020% or less, more preferably 0.002% or more, more preferably 0.015% or less.

REM is an element in effective in improving the strength and the corrosion resistance. To provide the effects, the REM content needs to be 0.0001% or more. However, if the REM content is more than 0.0200%, for example, inclusions are increased to cause defects and so forth on the surfaces and in the steel sheet, thereby decreasing the ductility and the stretch-flangeability. Accordingly, when REM is contained, the REM content is preferably 0.0001% or more and 0.0200% or less, more preferably 0.0005% or more, more preferably 0.0150% or less.

The steel microstructure, which is an important factor of the high-strength steel sheet of the disclosed embodiments, will be described below.

Area Percentage of Tempered Martensite: 75.0% or more

In the disclosed embodiments, this is a significantly important constituent feature. The use of the tempered martensite as a main phase is effective in ensuring desired hole expansion formability while desired strength (tensile strength) intended in the disclosed embodiments is ensured. Additionally, the fresh martensite can be adjoined to the tempered martensite, thereby enabling the control of YR. To provide the effects, the area percentage of the tempered martensite needs to be 75.0% or more. The upper limit of the area percentage of the tempered martensite is not particularly limited. To ensure the area percentage of the tempered martensite and the area percentage of the retained austenite, the area percentage of the tempered martensite is preferably 94.0% or less. Accordingly, the area percentage of the tempered martensite is 75.0% or more, preferably 76.0% or more, more preferably 78.0% or more, preferably 94.0% or less, more preferably 92.0% or less, even more preferably 90.0% or less. The area percentage of the tempered martensite can be measured by a method described in examples below.

Area Percentage of Fresh Martensite: 1.0% or more and 20.0% or less

In the disclosed embodiments, this is a significantly important constituent feature. By adjoining the fresh martensite to the tempered martensite, YR can be controlled while desired hole expansion formability is ensured. To provide the effect, the area percentage of the fresh martensite needs to be 1.0% or more. If the area percentage of the fresh martensite is more than 20.0%, the area percentage of the retained austenite is decreased, thereby decreasing the ductility. Furthermore, the stretch-flangeability is also decreased. Accordingly, the area percentage of the fresh martensite is 1.0% or more and 20.0% or less, preferably 1.0% or more and 15.0% or less. The area percentage of the fresh martensite can be measured by a method described in the examples below.

Area Percentage of Bainite: 10.0% or less (Preferred Condition)

The formation of bainite is effective in concentrating C in untransformed austenite to form the retained austenite that develops the TRIP effect in a high strain region during processing. Thus, the area percentage of bainite is preferably 10.0% or less. Because the area percentage of the fresh martensite required to control YR needs to be ensured, the area percentage of bainite is more preferably 8.0% or less. However, even if the area percentage of bainite is 0%, the advantageous effects of the disclosed embodiments are provided. The area percentage of bainite can be measured by a method described in the examples below.

Area Percentage of Retained Austenite: 5.0% or more and 20.0% or less

In the disclosed embodiments, this is a significantly important constituent feature. To achieve good ductility and a good balance between the tensile strength and the ductility, the area percentage of the retained austenite needs to be 5.0% or more. If the area percentage of the retained austenite is more than 20.0%, the grain size of the retained austenite is increased to decrease the hole expansion formability. Accordingly, the area percentage of the retained austenite is 5.0% or more and 20.0% or less, preferably 6.0% or more, preferably 18.0% or less, more preferably 7.0% or more, more preferably 16.0% or less. The area percentage of the retained austenite can be measured by a method described in the examples below.

Average Grain Size of Retained Austenite: 0.2 μm or more and 5.0 μm or less (Preferred Condition)

The retained austenite, which can achieve good ductility and a good balance between the tensile strength and the ductility, is transformed into the fresh martensite during punching work to form cracks at boundaries with the tempered martensite or bainite, thereby decreasing the hole expansion formability. This problem can be remedied by reducing the average grain size of the retained austenite to 5.0 μm or less. If the retained austenite has an average grain size of more than 5.0 μm, the retained austenite is subjected to martensitic transformation at the early stage of work hardening during tensile deformation, thereby decreasing the ductility. If the retained austenite has an average grain size of less than 0.2 μm, the retained austenite is not subjected to martensitic transformation even at the late stage of the work hardening during the tensile deformation. Thus, the retained austenite contributes less to the ductility, making it difficult to ensure desired El. Accordingly, the retained austenite preferably has an average grain size of 0.2 μm or more and 5.0 μm or less, more preferably 0.3 μm or more, more preferably 2.0 μm or less. The average grain size of the retained austenite can be measured by a method described in the examples below.

Hardness Ratio of Fresh Martensite to Tempered Martensite: 1.5 or more and 3.0 or less In the disclosed embodiments, this is a significantly important constituent feature. To control YR, which serves as an index of the controllability of YS, over a wide range, it is effective to appropriately control the hardness of the tempered martensite serving as a main phase and the hard fresh martensite adjacent thereto. This can control internal stress distribution in both the tempered and fresh martensite phases during tensile deformation, thus enabling the control of YR. If the hardness ratio of the fresh martensite to the tempered martensite is less than 1.5, the distribution of internal stress resulting from a difference in hardness between the tempered martensite and the fresh martensite is not sufficient, thus increasing YR. If the hardness ratio of the fresh martensite to the tempered martensite is more than 3.0, the distribution of internal stress resulting from the difference in hardness between the tempered martensite and the fresh martensite is increased, thereby decreasing YR and the stretch-flangeability. Accordingly, the hardness ratio of the fresh martensite to the tempered martensite is 1.5 or more and 3.0 or less, preferably 1.5 or more and 2.8 or less. The hardness ratio of the fresh martensite to the tempered martensite can be measured by a method described in the examples below.

Ratio of Maximum KAM Value in Tempered Martensite in Vicinity of Heterophase Interface Between Tempered Martensite and Fresh Martensite to Average KAM Value in Tempered Martensite: 1.5 or more and 30.0 or less In the disclosed embodiments, this is a significantly important constituent feature. To control YR, which serves as an index of the controllability of YS, over a wide range, it is effective to appropriately control the average KAM value in the tempered martensite serving as a main phase and the maximum KAM value in the tempered martensite in the vicinity of a heterophase interface between the tempered martensite and the fresh martensite. This enables the control of plastic strain distribution between the tempered martensite and the fresh martensite during the tensile deformation and enables the control of YR. If the ratio of the maximum KAM value in the tempered martensite in the vicinity of the heterophase interface between the tempered martensite and the fresh martensite to the average KAM value in the tempered martensite is less than 1.5, the difference in plastic strain between both the tempered and fresh martensite phases is small, thus increasing YR. If the ratio of the maximum KAM value in the tempered martensite in the vicinity of the heterophase interface between the tempered martensite and the fresh martensite to the average KAM value in the tempered martensite is more than 30.0, the difference in plastic strain between both the tempered and fresh martensite phases is large, thus decreasing YR. Accordingly, the ratio of the maximum KAM value in the tempered martensite in the vicinity of the heterophase interface between the tempered martensite and the fresh martensite to the average KAM value in the tempered martensite is 1.5 or more and 30.0 or less, preferably 1.6 or more, preferably 25.0 or less, more preferably 1.6 or more and 20.0 or less. The average KAM value in the tempered martensite and the maximum KAM value in the tempered martensite in the vicinity of the heterophase interface between the tempered martensite and the fresh martensite can be measured by methods described in the examples below.

Ratio of Grain Size of Prior Austenite Grain in Rolling Direction to that in Thickness Direction: 2.0 or less on Average In embodiments, this is a significantly important constituent feature. To control the in-plane anisotropy of YS, it is effective to appropriately control the ratio of the grain size of prior austenite grains in the rolling direction to that in the thickness direction (aspect ratio of the prior austenite). When the prior austenite grains have a shape close to an equiaxed shape, it is possible to reduce a change in YS in response to a tensile direction. To provide the effect, the ratio of the grain size of the prior austenite grains in the rolling direction to that in the thickness direction needs to be 2.0 or less on average. The lower limit of the ratio of the grain size of the prior austenite grains in the rolling direction to that in the thickness direction is preferably, but not necessarily, 0.5 or more on average in order to control the in-plane anisotropy of YS. Accordingly, the ratio of the grain size of the prior austenite grains in the rolling direction to that in the thickness direction is 2.0 or less on average, preferably 0.5 or more. The grain sizes of the prior austenite grains in those directions can be measured by a method described in the examples below.

In the steel microstructure according to the disclosed embodiments, when ferrite, pearlite, carbides such as cementite, and any known structure of steel sheets are contained in addition to the tempered martensite, the fresh martensite, the bainite, and the retained austenite described above, the advantageous effects of the disclosed embodiments are not impaired as long as the ferrite, the pearlite, the carbides such as cementite, and any known structure of steel sheets are contained in a total area percentage of 3.0% or less.

A method for producing a high-strength steel sheet of the disclosed embodiments will be described below.

The high-strength steel sheet of the disclosed embodiments is obtained by, in sequence, heating steel having the component composition described above, performing hot rolling at a finish rolling entry temperature of 1,020° C. or higher and 1,180° C. or lower and a finish rolling delivery temperature of 800° C. or higher and 1,000° C. or lower, performing coiling at a coiling temperature of 600° C. or lower, performing cold rolling, and performing annealing, in which letting a temperature defined by formula (1) be temperature T1 (° C.) and letting a temperature defined by formula (2) be temperature T2 (° C.), the annealing includes, in sequence: retaining heat (hereinafter, also referred to as "holding") at a heating temperature equal to or higher than temperature T1 for 10 s or more, performing cooling to a cooling stop temperature of 220° C. or higher and ((220° C.+temperature T2)/2) or lower, performing reheating from the cooling stop temperature to a reheating temperature of A or higher and 560° C. or lower (where A is a freely-selected temperature (° C.) that satisfies (temperature T2+20° C.) A 530° C.)) at an average heating rate of 10° C./s or more, and performing holding at a holding temperature (A) of (temperature T2+20° C.) or higher and 530° C. or lower for 10 s or more. The high-strength steel sheet obtained as described above may be subjected to coating treatment.

Detailed description will be given below. In the description, the expression "° C." relating to temperature refers to a surface temperature of the steel sheet. In the disclosed embodiments, the thickness of the high-strength steel sheet is not particularly limited. Usually, the disclosed embodiments are preferably applied to a high-strength steel sheet having a thickness of 0.3 mm or more and 2.8 mm or less.

In the disclosed embodiments, a method for making steel (steel slab) is not particularly limited, and any known method for making steel using a furnace such as a converter or an electric furnace may be employed. Although a casting process is not particularly limited, a continuous casting process is preferred. The steel slab (slab) is preferably produced by the continuous casting process in order to prevent macrosegregation. However, the steel slab may be produced by, for example, an ingot-making process or a thin slab casting process.

Any of the following processes may be employed in the disclosed embodiments with no problem: a conventional process in which a steel slab is produced, temporarily cooled to room temperature, and reheated; and energy-saving processes such as hot direct rolling and direct rolling in which a hot steel slab is transferred into a heating furnace without cooling to room temperature and is hot-rolled or in which a steel slab is slightly held and then immediately hot-rolled. In the case of hot-rolling the slab, the slab may be reheated to 1,100° C. or higher and 1,300° C. or lower in a heating furnace and then hot-rolled, or may be heated in a heating furnace set at a temperature of 1,100° C. or higher and 1,300° C. or lower for a short time and then hot-rolled. The slab is formed by rough rolling under usual conditions into a sheet bar. In the case where a low heating temperature is used, the sheet bar is preferably heated with, for example, a bar heater before finish rolling from the viewpoint of preventing trouble during hot rolling.

The steel obtained as described above is subjected to hot rolling. The hot rolling may be performed by rolling including rough rolling and finish rolling or by rolling consisting only of finish rolling excluding rough rolling. In any case, it is important to control the finish rolling entry temperature and the finish rolling delivery temperature.

[Finish rolling Entry Temperature: 1,020° C. or higher and 1,180° C. or lower]

The steel slab that has been heated is subjected to hot rolling including rough rolling and finish rolling into a hot-rolled steel sheet. At this time, if the finish rolling entry temperature is higher than 1,180° C., the amount of oxide (scale) formed is steeply increased to roughen the interface between base iron and the oxide. The descalability during descaling and pickling are degraded to degrade the surface quality of the steel sheet after annealing. For example, if the scale formed in the hot rolling is partially left on a portion of surfaces of the steel sheet after the pickling, the ductility and the hole expansion formability are adversely affected. Furthermore, the rolling reduction of austenite in an unrecrystallized state is decreased on the outlet side of the finish rolling to lead to an excessively large grain size of the austenite. Thus, the grain size of the prior austenite cannot be controlled during the annealing, thereby increasing the in-plane anisotropy of YS in the final product. A finish rolling entry temperature of lower than 1,020° C. results in a decrease in finish rolling delivery temperature. This increases the rolling force during the hot rolling, thereby increasing the rolling load. Furthermore, the rolling reduction of the austenite in an unrecrystallized state is increased to develop an abnormal structure extending in the rolling direction. Thus, the in-plane anisotropy of YS in the final product is significantly increased to impair material uniformity and material stability. Additionally, the ductility and the hole expansion formability are decreased. Accordingly, the finish rolling entry temperature in the hot rolling is 1,020° C. or higher and 1,180° C. or lower, preferably 1,020° C. or higher and 1,160° C. or lower.

[Rolling Reduction in a Pass before a Final Pass of Finish Rolling: 15% or more and 25% or less] (Preferred Condition)

In the disclosed embodiments, the rolling reduction in a pass before a final pass of the finish rolling is 15% or more and 25% or less; thus, the strength and the in-plane anisotropy of YS can be more appropriately controlled. If the rolling reduction in a pass before a final pass of the finish rolling is less than 15%, the austenite grains after rolling may be very coarse even if rolling is performed in a pass before a final pass. Thus, even if rolling is performed in the last pass, a phase formed during cooling after the last pass has a nonuniform grain size, what is called a duplex grain structure, in some cases. Thus, the grain size of the prior austenite cannot be controlled during the annealing, thereby possibly increasing the in-plane anisotropy of YS in a final product sheet. If the rolling reduction in a pass before a final pass of the finish rolling is more than 25%, the grain size of the austenite formed during the hot rolling through the last pass is degreased. The final product sheet produced through the cold rolling and the subsequent annealing has a reduced grain size, thereby increasing the strength, in particular, the yield strength to possibly increasing YR. Furthermore, a decrease in the grain size of the tempered martensite decreases the difference in plastic strain between both the tempered and fresh martensite phases, thereby possibly increasing YR. Accordingly, the rolling reduction in a pass before a final pass of the finish rolling is 15% or more and 25% or less.

[Rolling Reduction in Last Pass of Finish Rolling: 5% or more and 15% or less] (Preferred Condition)

In the disclosed embodiments, the strength and the in-plane anisotropy of YS can be more appropriately controlled by appropriately controlling the rolling reduction in a pass before a final pass of the finish rolling and controlling the rolling reduction in the last pass of the finish rolling. It is thus preferable to control the rolling reduction in the last pass of the finish rolling. If the rolling reduction in the last pass of the finish rolling is less than 5%, a phase formed during the cooling after the last pass has a nonuniform grain size, what is called a duplex grain structure. Thus, the grain size of the prior austenite cannot be controlled during the annealing, thereby possibly increasing the in-plane anisotropy of YS in the final product sheet. If the rolling reduction in the last pass of the finish rolling is more than 15%, the grain size of the austenite during the hot rolling is decreased. The final product sheet produced through the cold rolling and the subsequent annealing has a reduced grain size, thereby possibly increasing the strength, in particular, the yield strength to increase YR. Furthermore, a decrease in the grain size of the tempered martensite decreases the difference in plastic strain between both the tempered and fresh martensite phases, thereby possibly increasing YR. Accordingly, the rolling reduction in the last pass of the finish rolling is preferably 5% or more and 15% or less. More preferably, the rolling reduction in the last pass of the finish rolling is 6% or more and 14% or less.

[Finish rolling Delivery Temperature: 800° C. or higher and 1,000° C. or lower]

The steel slab that has been heated is subjected to the hot rolling including the rough rolling and the finish rolling into the hot-rolled steel sheet. At this time, if the finish rolling delivery temperature is higher than 1,000° C., the amount of oxide (scale) formed is steeply increased to roughen the interface between the base iron and the oxide. The surface quality of the steel sheet after the pickling and the cold rolling is degraded. For example, if the scale formed in the hot rolling is partially left on a portion of surfaces of the steel sheet after the pickling, the ductility and the hole expansion formability are adversely affected. Furthermore, the rolling reduction of austenite in an unrecrystallized state is decreased on the outlet side of the finish rolling to lead to an excessively large grain size of the austenite. Thus, the grain size of the prior austenite cannot be controlled during the annealing, thereby increasing the in-plane anisotropy of YS in the final product. A finish rolling delivery temperature of lower than 800° C. results in an increase in rolling force, thereby increasing the rolling load. Furthermore, the rolling reduction of the austenite in an unrecrystallized state is increased to develop an abnormal structure extending in the rolling direction. Thus, the in-plane anisotropy of YS in the final product is significantly increased to impair material uniformity and material stability. Additionally, the ductility and the hole expansion formability are decreased. Accordingly, the finish rolling delivery temperature in the hot rolling is 800° C. or higher and 1,000° C. or lower, preferably 820° C. or higher, preferably 950° C. or lower.

As described above, the hot rolling may be performed by rolling including the rough rolling and the finish rolling or by rolling consisting only of the finish rolling excluding the rough rolling.

[Coiling Temperature: 600° C. or lower]

If the coiling temperature after the hot rolling is higher than 600° C., the steel microstructure of the hot-rolled sheet (hot-rolled steel sheet) has ferrite and pearlite. Because the reverse transformation of austenite during the annealing occurs preferentially from the pearlite, the prior austenite grains have a nonuniform grain size, thereby increasing the in-plane anisotropy of YS in the final product. The lower limit of the coiling temperature is not particularly limited. If the coiling temperature after the hot rolling is lower than 300° C., the strength of the hot-rolled steel sheet is increased to increase the rolling load during the cold rolling, thereby decreasing the productivity. Furthermore, when such a hard hot-rolled steel sheet mainly containing martensite is cold-rolled, fine internal cracks (brittle cracks) in the martensite are easily formed along the grain boundaries of the prior austenite, thereby possibly decreasing the ductility and the stretch-flangeability of the final annealed sheet. Accordingly, the coiling temperature is 600° C. or lower, preferably 300° C. or higher, preferably 590° C. or lower.

Finish rolling may be continuously performed by joining rough-rolled sheets together during the hot rolling. Rough-rolled sheets may be temporarily coiled. To reduce the rolling force during the hot rolling, the finish rolling may be partially or entirely performed by lubrication rolling. The lubrication rolling is also effective from the viewpoint of achieving a uniform shape of the steel sheet and a homogeneous material. When the lubrication rolling is performed, the coefficient of friction is preferably in the range of 0.10 or more and 0.25 or less.

The hot-rolled steel sheet produced as described above can be subjected to pickling. Examples of a method of the pickling include, but are not particularly limited to, pickling with hydrochloric acid and pickling with sulfuric acid. The pickling enables removal of oxide from the surfaces of the steel sheet and thus is effective in ensuring good chemical convertibility and good coating quality of the high-strength steel sheet as the final product. When the pickling is performed, the pickling may be performed once or multiple times.

Thus-obtained sheet that has been subjected to the pickling treatment after the hot rolling is subjected to cold rolling. In the case of performing the cold rolling, the sheet that has been subjected to the pickling treatment after the hot rolling may be subjected to cold rolling as it is or may be subjected to heat treatment and then the cold rolling. The heat treatment may be performed under conditions described below.

[Heat Treatment of Hot-Rolled Steel Sheet: Cooling from Coiling Temperature to 200° C. or lower and then Heating and Holding in Heat Treatment Temperature Range of 450° C. or higher and 650° C. or lower for 900 s or more] (Preferred Condition)

After the coiling, by performing cooling from the coiling temperature to 200° C. or lower and then performing heating, the area percentage of the fresh martensite in the final microstructure can be appropriately controlled. Thus, desired YR and hole expansion formability can be ensured. If the heat treatment at 450° C. or higher and 650° C. or lower is performed while the cooling temperature subsequent to the coiling temperature is higher than 200° C., the fresh martensite is increased in the final microstructure to decrease YR, thereby possibly making it difficult to ensure desired hole expansion formability.

If a heat treatment temperature range is lower than 450° C. or if a holding time in a heat treatment temperature range is less than 900 s, because of insufficient tempering after the hot rolling, the rolling load is increased in the subsequent cold rolling. Thereby, the steel sheet can fail to be rolled to a desired thickness. Furthermore, because of the occurrence of non-uniform tempering in the microstructure, the reverse transformation of austenite occurs non-uniformly during the annealing after the cold rolling. This leads to the prior austenite grains having a non-uniform grain size, thereby possibly increasing the in-plane anisotropy of YS in the final product. If the heat treatment temperature range is higher than 650° C., a non-uniform microstructure containing ferrite and either martensite or pearlite is obtained, and the reverse transformation of austenite occurs non-uniformly during the annealing after the cold rolling. This leads to the prior austenite grains having a non-uniform grain size, thereby possibly increasing the in-plane anisotropy of YS in the final product. Accordingly, the heat treatment temperature range of the hot-rolled steel sheet after the pickling treatment is preferably in the temperature range of 450° C. or higher and 650° C. or lower, and the holding time in the temperature range is preferably 900 s or more. The upper limit of the holding time is not particularly limited. In view of the productivity, the upper limit of the holding time is preferably 36,000 s or less, more preferably 34,000 s or less.

The conditions of the cold rolling are not particularly limited. For example, the cumulative rolling reduction in the cold rolling is preferably about 30% to about 80% in view of the productivity. The number of rolling passes and the rolling reduction of each of the passes are not particularly limited. In any case, the advantageous effects of the disclosed embodiments can be provided.

The resulting cold-rolled steel sheet is subjected to the annealing (heat treatment) described below.

[Heating Temperature: temperature T1 or higher]

If the heating temperature in the annealing step is lower than temperature T1, the annealing is performed in ferrite and austenite two-phase region, and the final microstructure contains ferrite (polygonal ferrite), thereby making it difficult to ensure desired hole expansion formability. Furthermore, YS is decreased to decrease YR. The upper limit of the heating temperature in the annealing step is not particularly limited. If the heating temperature is higher than 950° C., the austenite grains during the annealing are coarsened. Finally, fine retained austenite is not formed, thereby possibly making it difficult to ensure desired ductility and stretch-flangeability (hole expansion formability). Accordingly, the heating temperature in the annealing step is temperature Ti or higher, preferably temperature T1 or higher and 950° C. or lower.

Here, temperature T1 (° C.) can be calculated from the following formula:

$$\text{temperature } T1(^\circ\text{ C.})=960-203\times[\%\text{ C}]^{1/2}+45\times[\%\text{ Si}]-30\times[\%\text{ Mn}]+150\times[\%\text{ Al}]-20\times[\%\text{ Cu}]+11\times[\%\text{ Cr}]+400\times[\%\text{ Ti}] \quad (1)$$

where [% X] indicates the component element X content (% by mass) of steel and is 0 if X is not contained.

The average heating rate to the heating temperature is not particularly limited. Usually, the average heating rate is preferably 0.5° C./s or more and 50.0° C./s or less.

[Holding Time at Heating Temperature: 10 s or more]

If the holding time in the annealing step is less than 10 s, the cooling is performed while the reverse transformation of austenite does not proceed sufficiently. This results in the formation of a structure in which the prior austenite grains are elongated in the rolling direction, thereby increasing the in-plane anisotropy of YS. Furthermore, when ferrite is left during the annealing, ferrite grows during the cooling. This results in the final microstructure containing ferrite (polygonal ferrite), thereby decreasing YR and making it difficult to ensure desired hole expansion formability. The upper limit of the holding time at the heating temperature in the annealing step is not particularly limited. In view of the productivity, the upper limit of the holding time is preferably 600 s or less. Accordingly, the holding time at the heating temperature is 10 s or more, preferably 30 s or more, preferably 600 s or less.

[Cooling Stop Temperature: 220° C. or higher ((220° C.+Temperature T2)/2) or lower]

If the cooling stop temperature is lower than 220° C., most of austenite present is transformed into martensite during the cooling. The martensite is transformed into tempered martensite by the subsequent reheating. Thus, the constituent phase cannot contain fresh martensite, thereby increasing YR and making it difficult to control YS. If the cooling stop temperature is higher than ((220° C.+temperature T2)/2), most of austenite present is not transformed into martensite during the cooling and then is reheated, thereby increasing tempered martensite in the final microstructure. This decreases YR and makes it difficult to ensure desired hole expansion formability. Accordingly, the cooling stop temperature is 220° C. or higher and ((220° C.+temperature T2)/2) or lower, preferably 240° C. or higher. However, when ((220° C.+temperature T2)/2) is 250° C. or lower, an appropriate amount of martensite can be obtained in a cooling stop temperature range of 220° C. or higher and 250° C. or lower. Thus, when ((220° C.+temperature T2)/2) is 250° C. or lower, the cooling stop temperature is 220° C. or higher and 250° C. or lower. Here, temperature T2 (° C.) can be calculated by the following formula:

$$\text{temperature } T2(^\circ\text{ C.})=560-566\times[\%\text{ C}]-150\times[\%\text{ C}]\times[\%\text{ Mn}]-7.5\times[\%\text{ Si}]+15\times[\%\text{ Cr}]-67.6\times[\%\text{ C}]\times[\%\text{ Cr}] \quad (2)$$

where [% X] indicates the component element X content (% by mass) of steel and is 0 if X is not contained.

The average cooling rate during the cooling described above is not particularly limited and is usually 5° C./s or more and 100° C./s or less.

[Reheating Temperature: A or Higher and 560° C. or Lower (Where A Is Freely-Selected Temperature (° C.) That Satisfies (Temperature T2+20° C.) A 530° C.)]

This is a significantly important control factor in the disclosed embodiments. Martensite and austenite present during the cooling are reheated to temper the martensite and to diffuse C dissolved in the martensite in a supersaturated state into the austenite, thereby enabling the formation of austenite stable at room temperature. To provide the effect, the reheating temperature in the annealing step needs to be equal to higher than the holding temperature described below. If the reheating temperature is lower than the holding temperature, C does not concentrate in untransformed austenite present during the reheating, and bainite is formed during the subsequent holding, thereby increasing YS and YR.

If the reheating temperature is higher than 560° C., the austenite is decomposed into pearlite. Thus, retained austenite is not formed, thereby increasing YR to decrease the ductility. Accordingly, the reheating temperature is the holding temperature A or higher and 560° C. or lower, preferably the holding temperature A or higher and 530° C. or lower.

The reheating temperature is a temperature equal to or higher than the holding temperature A described below. When the holding is performed after the reheating, C concentrates in the austenite present at the stop of the cooling simultaneously with the tempering of the martensite. When the reheating temperature is the holding temperature A or higher, the concentration of C in the austenite is promoted to delay bainitic transformation during the subsequent reheating. Thus, a desired fraction of the fresh martensite can be formed to control YR. Accordingly, the reheating temperature is preferably 400° C. to 560° C., more preferably 430° C. or higher, more preferably 520° C. or lower, even more preferably 440° C. or higher, even more preferably 500° C. or lower.

[Average Heating Rate from Cooling Stop Temperature to Reheating Temperature: 10° C./s or more]

This is a significantly important control factor in the disclosed embodiments. If the average heating rate is less than 10° C./s in the temperature range of the cooling stop temperature to the reheating temperature, bainite is formed during the reheating, thereby decreasing the fresh martensite in the final microstructure to increase YR. The upper limit of the average heating rate in the temperature range of the cooling stop temperature to the reheating temperature is not particularly limited. In view of the productivity, the upper limit is preferably 200° C./s or less. Accordingly, the average heating rate in the temperature range of the cooling stop temperature to the reheating temperature in the annealing step is 10° C./s or more, preferably 10° C./s or more and 200° C./s or less, more preferably 10° C./s or more and 100° C./s or less.

[Holding Temperature (A): (Temperature T2+20° C.) or higher and 530° C. or lower]

This is a significantly important control factor in the disclosed embodiments. Desired hole expansion formability can be ensured by sufficiently tempering martensite present during the reheating. YR, which serves as an index of the controllability of YS, can be controlled by controlling the hardness of the tempered martensite and the hardness of the fresh martensite. To provide the effects, the holding temperature needs to be (temperature T2+20° C.) or higher. If the holding temperature is lower than (temperature T2+20° C.), the martensite present during the reheating is not sufficiently tempered, thereby increasing TS to decrease the ductility. Additionally, the difference in hardness between the tempered martensite and the fresh martensite is decreased to increase YR. If the holding temperature is higher than 530° C., the tempering of the martensite is promoted to make it difficult to ensure desired strength. If austenite is decomposed into pearlite, YR is increased, thereby possibly decreasing the ductility. Accordingly, the holding temperature (A) in the annealing step is (temperature T2+20° C.) or higher and 530° C. or lower, preferably (temperature T2+20° C.) or higher and 500° C. or lower.

[Holding Time at Holding Temperature: 10 s or more]

If the holding time at the holding temperature in the annealing step is less than 10 s, the cooling is performed while the tempering of martensite present during the reheating does not sufficiently proceed. This results in a smaller difference in hardness between the tempered martensite and the fresh martensite, thereby increasing YR. The upper limit of the holding time at the holding temperature is not particularly limited. In view of the productivity, the upper limit is preferably 1,000 s or less. Accordingly, the holding time at the holding temperature is 10 s or more, preferably 10 s or more and 1,000 s or less, more preferably 10 s or more and 700 s or less.

The cooling after the holding at the holding temperature in the annealing step need not be particularly specified. The cooling may be performed to a desired temperature by a freely-selected method. The desired temperature is preferably about room temperature from the viewpoint of preventing oxidation of the surfaces of the steel sheet. The average cooling rate in the cooling is preferably 1 to 50° C./s.

In this way, the high-strength steel sheet of the disclosed embodiments is produced.

The material of the resulting high-strength steel sheet of the disclosed embodiments is not affected by zinc-based coating treatment or the composition of a coating bath, and the advantageous effects of the disclosed embodiments are provided. Thus, coating treatment described below can be performed to provide a coated steel sheet.

The high-strength steel sheet of the disclosed embodiments can be subjected to temper rolling (skin pass rolling). In the case where the temper rolling is performed, if the rolling reduction in the skin pass rolling is more than 2.0%, the yield stress of steel is increased to increase YR. Thus, the rolling reduction is preferably 2.0% or less. The lower limit of the rolling reduction in the skin pass rolling is not particularly limited. In view of the productivity, the lower limit of the rolling reduction is preferably 0.1% or more.

In the case where a thin steel sheet is a product, usually, the high-strength steel sheet is cooled to room temperature and then used as a product.

[Coating Treatment] (Preferred Condition)

A method for producing a coated steel sheet of the disclosed embodiments is a method in which a cold-rolled steel sheet (thin steel sheet) is subjected to coating. Examples of the coating treatment include galvanizing treatment and treatment in which alloying is performed after the galvanizing treatment (galvannealing treatment). The annealing and the galvanization may be continuously performed on a single line. A coated layer may be formed by electroplating such as Zn—Ni alloy plating. Hot-dip zinc-aluminum-magnesium alloy coating may be performed. While galvanization is mainly described herein, the type of coating metal such as Zn coating or Al coating is not particularly limited.

For example, in the case where the galvanizing treatment is performed, after the thin steel sheet is subjected to galvanizing treatment by immersing the thin steel sheet in a galvanizing bath having a temperature of 440° C. or higher and 500° C. or lower, the coating weight is adjusted by, for example, gas wiping. At lower than 440° C., zinc is not dissolved, in some cases. At higher than 500° C., the alloying of the coating proceeds excessively, in some cases. In the galvanization, the galvanizing bath having an Al content of 0.10% or more by mass and 0.23% or less by mass is preferably used. An Al content of less than 0.10% by mass can result in the formation of a hard brittle Fe—Zn alloy layer at the coated layer-base iron interface during the galvanization to cause a decrease in the adhesion of the coating and the occurrence of nonuniform appearance. An Al content of more than 0.23% by mass can result in the formation of a thick Fe—Al alloy layer at the coated layer-base iron interface immediately after the immersion in the galvanizing bath, thereby hindering the formation of a Fe—Zn alloy layer and increasing the alloying temperature to decrease the ductility. The coating weight is preferably 20 to 80 g/m$^2$ per side. Both sides are coated.

In the case where alloying treatment of the galvanized coating (galvannealing) is performed, the alloying treatment of the galvanized coating is performed in the temperature range of 470° C. to 600° C. after the galvanization treatment. At lower than 470° C., the Zn—Fe alloying rate is very low, thereby decreasing the productivity. If the alloying treatment is performed at higher than 600° C., untransformed austenite can be transformed into pearlite to decrease TS. Accordingly, when the alloying treatment of the galvanized coating is performed, the alloying treatment is preferably performed in the temperature range of 470° C. to 600° C., more preferably 470° C. to 560° C. In the galvannealed steel sheet (GA), the Fe concentration in the coated layer is preferably 7% to 15% by mass by performing the alloying treatment.

For example, in the case where electrogalvanizing treatment is performed, a galvanizing bath having a temperature of room temperature or higher and 100° C. or lower is preferably used. The coating weight per side is preferably 20 to 80 g/m$^2$.

The conditions of other production methods are not particularly limited. In view of the productivity, a series of treatments such as the annealing, the galvanization, and the alloying treatment of the galvanized coating are preferably performed on a continuous galvanizing line (CGL), which is a galvanizing line. After the galvanization, wiping can be performed in order to adjust the coating weight. Regarding conditions such as coating other than the conditions described above, the conditions of a commonly used galvanization method can be used.

[Temper Rolling] (Preferred Condition)

In the case where the temper rolling is performed, the rolling reduction in a skin pass rolling after the coating treatment is preferably in the range of 0.1% to 2.0%. If the rolling reduction in the skin pass rolling is less than 0.1%, the effect is low, and it is difficult to control the rolling reduction to the level. Thus, the value is set to the lower limit of the preferred range. If the rolling reduction in the skin pass rolling is more than 2.0%, the productivity is significantly decreased, and YR is increased. Thus, the value is set to the upper limit of the preferred range. The skin pass rolling may be performed on-line or off-line. To achieve an intended rolling reduction, a skin pass may be performed once or multiple times.

EXAMPLES

The operation and advantageous effects of the high-strength steel sheet of the disclosed embodiments and the method for producing the high-strength steel sheet will be described below by examples. The disclosed embodiments are not limited to these examples described below.

Molten steels having component compositions listed in Tables 1-1 and 1-2, the balance being Fe and incidental impurities, were produced in a converter and then formed into steel slabs by a continuous casting process. The resulting steel slabs were heated at 1,250° C. and subjected to hot rolling, coiling, and pickling treatment under conditions listed in Tables 2-1 and 2-2. The hot-rolled steel sheets of No. 1 to 20, 22, 23, 25, 27, 29, 30, 32 to 37, 39, 41 to 63, and 65 to 70 presented in Tables 2-1 and 2-2 were subjected to heat treatment under the conditions listed in Tables 2-1 and 2-2.

Then cold rolling was performed at a rolling reduction of 50% to form cold-rolled steel sheets having a thickness of 1.2 mm. The resulting cold-rolled steel sheets were subjected to annealing treatment under the conditions listed in Tables 2-1 and 2-2 to provide high-strength cold-rolled steel sheets (CR). In the annealing treatment, the average heating rate to a heating temperature was 1 to 10° C./s. The average cooling rate to a cooling stop temperature was 5 to 30° C./s. The cooling stop temperature in cooling after holding at a holding temperature was room temperature. The average cooling rate in the cooling was 1 to 10° C./s.

Some high-strength cold-rolled steel sheets (thin steel sheets) were subjected to coating treatment to provide galvanized steel sheets (GI), galvannealed steel sheets (GA), and electrogalvanized steel sheets (EG). Regarding galvanizing baths, a zinc bath containing Al: 0.14% to 0.19% by mass was used for each GI, and a zinc bath containing Al: 0.14% by mass was used for each GA. The bath temperature thereof was 470° C. GI had a coating weight of about 45 to about 72 g/m$^2$ per side. GA had a coating weight of about 45 g/m$^2$ per side. Both sides of each of GI and GA were coated. The coated layers of GA had a Fe concentration of 9% or more by mass and 12% or less by mass. Each EG had Zn—Ni alloy coated layers having a Ni content of 9% or more by mass and 25% or less by mass.

Temperature T1 (° C.) presented in Tables 1-1 and 1-2 was determined by means of formula (1):

$$\text{temperature } T1(^\circ\text{C.}) = 960 - 203\times[\%\ \text{C}]^{1/2} + 45\times[\%\ \text{Si}] - 30\times[\%\ \text{Mn}] + 150\times[\%\ \text{Al}] - 20\times[\%\ \text{Cu}] + 11\times[\%\ \text{Cr}] + 400\times[\%\ \text{Ti}] \quad (1)$$

Temperature T2 (° C.) presented in Tables 1-1 and 1-2 was determined by means of formula (2):

$$\text{temperature } T2(^\circ\text{C.}) = 560 - 566\times[\%\ \text{C}] - 150\times[\%\ \text{C}]\times[\%\ \text{Mn}] - 7.5\times[\%\ \text{Si}] + 15\times[\%\ \text{Cr}] - 67.6\times[\%\ \text{C}]\times[\%\ \text{Cr}] \quad (2)$$

where [% X] indicates the component element X content (% by mass) of steel and is calculated as 0 if X is not contained.

TABLE 1-1

| Type of steel | Component composition (% by mass) | | | | | | | | | | | | | | |
|---|---|---|---|---|---|---|---|---|---|---|---|---|---|---|---|
| | C | Si | Mn | P | S | Al | N | Ti | Nb | V | B | Mo | Cr | Cu | Ni |
| A | 0.220 | 1.41 | 2.87 | 0.009 | 0.0048 | 0.040 | 0.0039 | — | — | — | — | — | — | — | — |
| B | 0.207 | 1.34 | 2.72 | 0.043 | 0.0005 | 0.028 | 0.0030 | — | — | — | — | — | — | — | — |
| C | 0.174 | 1.42 | 2.83 | 0.044 | 0.0021 | 0.028 | 0.0023 | — | — | — | — | — | — | — | — |
| D | 0.199 | 1.56 | 2.83 | 0.038 | 0.0027 | 0.033 | 0.0029 | — | — | — | — | — | — | — | — |
| E | 0.182 | 1.31 | 2.97 | 0.049 | 0.0048 | 0.030 | 0.0017 | — | — | — | — | — | — | — | — |
| F | 0.164 | 1.43 | 2.84 | 0.015 | 0.0040 | 0.039 | 0.0028 | — | — | — | — | — | — | — | — |
| G | 0.164 | 1.49 | 2.78 | 0.036 | 0.0024 | 0.033 | 0.0013 | — | — | — | — | — | — | — | — |
| H | 0.071 | 1.67 | 2.89 | 0.024 | 0.0021 | 0.026 | 0.0036 | — | — | — | — | — | — | — | — |
| I | 0.194 | 0.45 | 2.97 | 0.017 | 0.0022 | 0.027 | 0.0031 | — | — | — | — | — | — | — | — |
| J | 0.176 | 1.20 | 1.95 | 0.008 | 0.0023 | 0.038 | 0.0048 | — | — | — | — | — | — | — | — |
| K | 0.169 | 1.26 | 3.81 | 0.018 | 0.0007 | 0.048 | 0.0028 | — | — | — | — | — | — | — | — |
| L | 0.172 | 1.34 | 2.57 | 0.045 | 0.0030 | 0.030 | 0.0016 | — | — | — | — | — | — | — | — |
| M | 0.171 | 1.43 | 2.54 | 0.038 | 0.0044 | 0.048 | 0.0026 | 0.044 | — | — | — | — | — | — | — |
| N | 0.185 | 1.30 | 2.86 | 0.043 | 0.0033 | 0.023 | 0.0016 | — | 0.039 | — | — | — | — | — | — |
| O | 0.191 | 1.33 | 2.69 | 0.020 | 0.0013 | 0.032 | 0.0016 | 0.023 | — | — | 0.0016 | — | — | — | — |
| P | 0.166 | 1.42 | 2.63 | 0.024 | 0.0030 | 0.030 | 0.0028 | — | — | 0.035 | — | — | 0.21 | — | — |
| Q | 0.188 | 1.34 | 2.85 | 0.032 | 0.0033 | 0.036 | 0.0011 | — | — | — | — | 0.052 | — | 0.25 | — |

TABLE 1-1-continued

| | | | | | | | | | | | | | | | |
|---|---|---|---|---|---|---|---|---|---|---|---|---|---|---|---|
| R | 0.169 | 1.41 | 2.79 | 0.031 | 0.0038 | 0.032 | 0.0018 | — | — | — | — | — | — | — | 0.15 |
| S | 0.191 | 1.36 | 2.87 | 0.024 | 0.0041 | 0.028 | 0.0030 | — | — | — | — | — | — | — | — |
| T | 0.188 | 1.36 | 2.89 | 0.017 | 0.0015 | 0.033 | 0.0020 | — | — | — | — | — | — | — | — |
| U | 0.168 | 1.35 | 2.99 | 0.011 | 0.0033 | 0.045 | 0.0045 | — | 0.029 | — | — | — | — | — | — |
| V | 0.199 | 1.32 | 2.53 | 0.041 | 0.0049 | 0.042 | 0.0031 | — | 0.032 | — | — | — | — | — | — |
| W | 0.179 | 1.53 | 2.84 | 0.033 | 0.0042 | 0.030 | 0.0020 | — | 0.045 | — | — | — | — | — | — |
| X | 0.178 | 1.22 | 2.63 | 0.010 | 0.0025 | 0.020 | 0.0017 | — | — | — | — | — | — | — | — |
| Y | 0.205 | 1.35 | 2.65 | 0.034 | 0.0006 | 0.025 | 0.0044 | — | — | — | — | — | — | — | — |
| Z | 0.161 | 1.46 | 2.78 | 0.045 | 0.0024 | 0.045 | 0.0043 | — | — | — | — | — | — | — | — |

| Type of | Component composition (% by mass) | | | | | | | | | | Temperature T1 | Temperature T2 |
|---|---|---|---|---|---|---|---|---|---|---|---|---|
| steel | As | Sb | Sn | Ta | Ca | Mg | Zn | Co | Zr | REM | (° C.) | (° C.) |
| A | — | — | — | — | — | — | — | — | — | — | 848 | 330 |
| B | — | — | — | — | — | — | — | — | — | — | 851 | 348 |
| C | — | — | — | — | — | — | — | — | — | — | 858 | 377 |
| D | — | — | — | — | — | — | — | — | — | — | 860 | 352 |
| E | — | — | — | — | — | — | — | — | — | — | 848 | 366 |
| F | — | — | — | — | — | — | — | — | — | — | 863 | 386 |
| G | — | — | — | — | — | — | — | — | — | — | 867 | 388 |
| H | — | — | — | — | — | — | — | — | — | — | 898 | 477 |
| I | — | — | — | — | — | — | — | — | — | — | 806 | 361 |
| J | — | — | — | — | — | — | — | — | — | — | 876 | 400 |
| K | — | — | — | — | — | — | — | — | — | — | 826 | 359 |
| L | — | — | — | — | — | — | — | — | — | — | 863 | 386 |
| M | — | — | — | — | — | — | — | — | — | — | 889 | 388 |
| N | — | — | — | — | — | — | — | — | — | — | 849 | 366 |
| O | — | — | — | — | — | — | — | — | — | — | 864 | 365 |
| P | — | — | — | — | — | — | — | — | — | — | 869 | 391 |
| Q | — | — | — | — | — | — | — | — | — | — | 847 | 363 |
| R | — | 0.005 | — | — | — | — | — | — | — | — | 861 | 383 |
| S | 0.009 | — | 0.011 | — | — | — | — | — | — | — | 851 | 359 |
| T | — | — | — | 0.006 | — | — | — | — | — | — | 851 | 362 |
| U | — | 0.012 | — | — | — | — | — | — | — | — | 855 | 380 |
| V | — | — | 0.004 | — | — | — | — | — | — | — | 859 | 362 |
| W | — | — | — | 0.009 | — | — | — | — | — | — | 862 | 370 |
| X | — | — | — | — | 0.0051 | — | — | — | — | — | 853 | 380 |
| Y | — | — | — | — | — | 0.0019 | 0.003 | 0.005 | 0.002 | — | 853 | 352 |
| Z | — | — | — | — | — | — | — | — | — | 0.0035 | 868 | 391 |

Underlined portions: values are outside the range of the disclosed embodiments.

Note 1:

temperature T1 (° C.) = 960 − 203 × [% C]$^{1/2}$ + 45 × [% Si] − 30 × [% Mn] + 150 × [% Al] − 20 × [% Cu] + 11 × [% Cr] + 400 × [% Ti] . . . (1)

[% X] indicates the component element X content (% by mass) of steel and is 0 if X is not contained.

Note 2:

[temperature T2 (° C.) = 560 − 566 × [% C] − 150 × [% C] × [% Mn] − 7.5 × [% Si] + 15 × [% Cr] − 67.6 × [% C] × [% Cr] . . . (2)

[% X] indicates the component element X content (% by mass) of steel and is 0 if X is not contained.

TABLE 1-2

| Type of | Component composition (% by mass) | | | | | | | | | | | | | |
|---|---|---|---|---|---|---|---|---|---|---|---|---|---|---|
| steel | C | Si | Mn | P | S | Al | N | Ti | Nb | V | B | Mo | Cr | Cu |
| AA | 0.172 | 1.31 | 2.75 | 0.009 | 0.0007 | 0.032 | 0.0023 | 0.005 | | — | — | — | — | — |
| AB | 0.165 | 1.49 | 2.62 | 0.006 | 0.0020 | 0.049 | 0.0034 | 0.050 | | — | — | — | — | — |
| AC | 0.200 | 1.35 | 2.67 | 0.003 | 0.0013 | 0.022 | 0.0015 | — | 0.005 | — | — | — | — | — |
| AD | 0.198 | 1.50 | 2.82 | 0.012 | 0.0004 | 0.035 | 0.0022 | — | 0.050 | — | — | — | — | — |
| AE | 0.185 | 1.45 | 2.85 | 0.007 | 0.0015 | 0.075 | 0.0050 | 0.014 | — | — | 0.0005 | — | — | — |
| AF | 0.189 | 1.38 | 2.60 | 0.018 | 0.0025 | 0.033 | 0.0043 | 0.035 | — | — | 0.0030 | — | — | — |
| AG | 0.178 | 1.41 | 2.71 | 0.004 | 0.0022 | 0.044 | 0.0035 | — | — | — | — | 0.034 | — | — |
| AH | 0.192 | 1.39 | 2.75 | 0.035 | 0.0008 | 0.057 | 0.0048 | — | — | — | — | 0.253 | — | — |
| AI | 0.195 | 1.44 | 2.84 | 0.005 | 0.0011 | 0.020 | 0.0019 | — | — | — | — | — | 0.03 | — |
| AJ | 0.168 | 1.46 | 2.87 | 0.010 | 0.0009 | 0.100 | 0.0017 | — | — | — | — | — | 0.50 | — |
| AK | 0.193 | 1.30 | 2.90 | 0.009 | 0.0010 | 0.035 | 0.0027 | — | — | — | — | — | — | — |
| AL | 0.188 | 1.48 | 2.77 | 0.011 | 0.0018 | 0.044 | 0.0030 | — | — | — | — | — | — | — |
| AM | 0.182 | 1.47 | 2.61 | 0.015 | 0.0019 | 0.056 | 0.0018 | — | — | — | — | — | — | — |
| AN | 0.166 | 1.34 | 2.89 | 0.023 | 0.0036 | 0.027 | 0.0049 | — | — | — | — | — | — | — |
| AO | 0.150 | 1.48 | 2.99 | 0.025 | 0.0038 | 0.036 | 0.0022 | — | — | — | — | — | — | — |
| AP | 0.260 | 1.35 | 2.51 | 0.042 | 0.0026 | 0.044 | 0.0031 | — | — | — | — | — | — | — |
| AQ | 0.197 | 1.00 | 2.85 | 0.039 | 0.0054 | 0.038 | 0.0038 | — | — | — | — | — | — | — |
| AR | 0.172 | 2.00 | 2.76 | 0.016 | 0.0023 | 0.036 | 0.0014 | — | — | — | — | — | — | — |
| AS | 0.204 | 1.54 | 2.30 | 0.052 | 0.0017 | 0.032 | 0.0026 | — | — | — | — | — | — | — |
| AT | 0.162 | 1.42 | 3.20 | 0.046 | 0.0046 | 0.039 | 0.0029 | — | — | — | — | — | — | — |
| AU | 0.171 | 1.33 | 2.96 | 0.100 | 0.0022 | 0.047 | 0.0036 | — | — | — | — | — | — | — |

TABLE 1-2-continued

| | | | | | | | | | | | | | | |
|---|---|---|---|---|---|---|---|---|---|---|---|---|---|---|
| AV | 0.173 | 1.46 | 2.62 | 0.028 | 0.0200 | 0.065 | 0.0037 | — | — | — | — | — | — | — |
| AW | 0.168 | 1.36 | 2.55 | 0.031 | 0.0045 | 0.500 | 0.0033 | — | — | — | — | — | — | — |
| AX | 0.161 | 1.32 | 2.72 | 0.026 | 0.0043 | 0.042 | 0.0005 | — | — | — | — | — | — | — |
| AY | 0.195 | 1.43 | 2.74 | 0.045 | 0.0037 | 0.057 | 0.0070 | — | — | — | — | — | — | — |

| Type of steel | Component composition (% by mass) | | | | | | | | | | | Temperature T1 (° C.) | Temperature T2 (° C.) |
|---|---|---|---|---|---|---|---|---|---|---|---|---|---|
| | Ni | As | Sb | Sn | Ta | Ca | Mg | Zn | Co | Zr | REM | | |
| AA | — | — | — | — | — | — | — | — | — | — | — | 859 | 382 |
| AB | — | — | — | — | — | — | — | — | — | — | — | 893 | 391 |
| AC | — | — | — | — | — | — | — | — | — | — | — | 853 | 357 |
| AD | — | — | — | — | — | — | — | — | — | — | — | 858 | 353 |
| AE | — | — | — | — | — | — | — | — | — | — | — | 869 | 365 |
| AF | — | — | — | — | — | — | — | — | — | — | — | 875 | 369 |
| AG | — | — | — | — | — | — | — | — | — | — | — | 863 | 376 |
| AH | — | — | — | — | — | — | — | — | — | — | — | 860 | 362 |
| AI | — | — | — | — | — | — | — | — | — | — | — | 853 | 356 |
| AJ | — | — | — | — | — | — | — | — | — | — | — | 877 | 383 |
| AK | — | — | 0.002 | — | — | — | — | — | — | — | — | 848 | 357 |
| AL | — | — | 0.100 | — | — | — | — | — | — | — | — | 862 | 364 |
| AM | — | — | — | — | — | 0.0002 | — | — | — | — | — | 870 | 375 |
| AN | — | — | — | — | — | 0.0100 | — | — | — | — | — | 855 | 384 |
| AO | — | — | — | — | — | — | — | — | — | — | — | 864 | 397 |
| AP | — | — | — | — | — | — | — | — | — | — | — | 849 | 305 |
| AQ | — | — | — | — | — | — | — | — | — | — | — | 835 | 357 |
| AR | — | — | — | — | — | — | — | — | — | — | — | 888 | 376 |
| AS | — | — | — | — | — | — | — | — | — | — | — | 873 | 363 |
| AT | — | — | — | — | — | — | — | — | — | — | — | 852 | 380 |
| AU | — | — | — | — | — | — | — | — | — | — | — | 854 | 377 |
| AV | — | — | — | — | — | — | — | — | — | — | — | 872 | 383 |
| AW | — | — | — | — | — | — | — | — | — | — | — | 936 | 390 |
| AX | — | — | — | — | — | — | — | — | — | — | — | 863 | 393 |
| AY | — | — | — | — | — | — | — | — | — | — | — | 861 | 359 |

Underlined portions: values are outside the range of the disclosed embodiments.

Note 1:

temperature T1 (° C.) = 960 − 203 × [% C]$^{1/2}$ + 45 × [% Si] − 30 × [% Mn] + 150 × [% Al] − 20 × [% Cu] + 11 × [% Cr] + 400 × [% Ti] . . . (1)

[% X] indicates the component element X content (% by mass) of steel and is 0 if X is not contained.

Note 2:

temperature T2 (° C.) = 560 − 566 × [% C] − 150 × [% C] × [% Mn] − 7.5 × [% Si] + 15 × [% Cr] − 67.6 × [% C] × [% Cr] . . . (2)

[% X] indicates the component element X content (% by mass) of steel and is 0 if X is not contained.

TABLE 2-1

| | | Hot rolling | | | | | | Heat treatment of hot-rolled steel sheet | |
|---|---|---|---|---|---|---|---|---|---|
| No. | Type of steel | Finish rolling entry temperature (° C.) | Finish rolling delivery temperature (° C.) | Rolling reduction in a pass before a final pass of a finish rolling (%) | Rolling reduction in last pass of finish rolling (%) | Cooling temperature (° C.) | Cooling temperature after coiling (° C.) | Heat treatment temperature (° C.) | Heat treatment time (s) |
| 1 | A | 1050 | 890 | 19 | 9 | 570 | 50 | 510 | 18000 |
| 2 | B | 1060 | 870 | 18 | 10 | 510 | 80 | 500 | 10000 |
| 3 | C | 1110 | 910 | 20 | 9 | 450 | 70 | 530 | 14000 |
| 4 | C | 990 | 860 | 23 | 12 | 480 | 80 | 550 | 18000 |
| 5 | C | 1210 | 930 | 22 | 12 | 590 | 50 | 520 | 15000 |
| 6 | C | 1130 | 780 | 19 | 13 | 490 | 25 | 530 | 20000 |
| 7 | C | 1060 | 1040 | 21 | 12 | 510 | 30 | 530 | 23000 |
| 8 | C | 1160 | 880 | 20 | 13 | 680 | 25 | 600 | 21000 |
| 9 | C | 1050 | 880 | 23 | 11 | 560 | 40 | 520 | 22000 |
| 10 | C | 1130 | 890 | 22 | 12 | 540 | 40 | 550 | 25000 |
| 11 | C | 1110 | 900 | 20 | 10 | 440 | 50 | 540 | 26000 |
| 12 | C | 1050 | 890 | 18 | 14 | 550 | 70 | 560 | 18000 |
| 13 | C | 1060 | 920 | 19 | 13 | 540 | 80 | 520 | 10000 |
| 14 | C | 1060 | 870 | 22 | 11 | 440 | 90 | 560 | 18000 |
| 15 | C | 1070 | 880 | 23 | 12 | 520 | 30 | 550 | 15000 |
| 16 | C | 1120 | 910 | 20 | 12 | 450 | 25 | 530 | 20000 |
| 17 | C | 1050 | 900 | 21 | 12 | 420 | 70 | 550 | 16000 |
| 18 | C | 1060 | 900 | 20 | 10 | 430 | 60 | 510 | 23000 |
| 19 | D | 1060 | 880 | 19 | 10 | 580 | 50 | 530 | 18000 |
| 20 | E | 1120 | 870 | 21 | 12 | 570 | 50 | 590 | 12000 |

TABLE 2-1-continued

| | | | | | | | | | |
|---|---|---|---|---|---|---|---|---|---|
| 21 | F | 1160 | 950 | 24 | 10 | 420 | 25 | — | — |
| 22 | G | 1070 | 860 | 17 | 12 | 580 | 40 | 590 | 20000 |
| 23 | H | 1060 | 870 | 18 | 11 | 570 | 70 | 510 | 1000 |
| 24 | I | 1050 | 860 | 20 | 12 | 560 | 25 | — | — |
| 25 | J | 1060 | 880 | 19 | 10 | 540 | 60 | 550 | 26000 |
| 26 | K | 1090 | 910 | 16 | 6 | 440 | 50 | — | — |
| 27 | L | 1110 | 900 | 21 | 12 | 510 | 80 | 570 | 21000 |
| 28 | M | 1050 | 900 | 19 | 9 | 500 | 25 | — | — |
| 29 | N | 1060 | 890 | 23 | 12 | 560 | 90 | 560 | 16000 |
| 30 | O | 1090 | 890 | 25 | 11 | 460 | 30 | 520 | 18000 |
| 31 | P | 1130 | 890 | 15 | 9 | 470 | 25 | — | — |
| 32 | Q | 1050 | 880 | 18 | 12 | 560 | 50 | 480 | 14000 |
| 33 | R | 1060 | 860 | 20 | 12 | 520 | 50 | 500 | 20000 |
| 34 | S | 1060 | 870 | 21 | 13 | 520 | 40 | 520 | 15000 |
| 35 | T | 1070 | 920 | 23 | 10 | 490 | 80 | 490 | 28000 |
| 36 | U | 1150 | 910 | 19 | 10 | 520 | 70 | 600 | 11000 |
| 37 | V | 1050 | 890 | 24 | 11 | 530 | 30 | 500 | 34000 |
| 38 | W | 1060 | 880 | 18 | 12 | 330 | 60 | — | — |
| 39 | X | 1020 | 820 | 23 | 13 | 530 | 25 | 530 | 29000 |

| | Annealing treatment | | | | | | | |
|---|---|---|---|---|---|---|---|---|
| No. | Heating temperature (° C.) | Holding time at heating temperature (s) | Cooling stop temperature (° C.) | Average heating rate from cooling stop temperature to reheating temperature (° C./s) | Reheating temperature (° C.) | Holding temperature (° C.) | Holding time at holding temperature (s) | Type* |
| 1 | 870 | 60 | 250 | 25 | 500 | 420 | 180 | CR |
| 2 | 860 | 250 | 270 | 12 | 460 | 440 | 190 | GI |
| 3 | 880 | 100 | 290 | 23 | 490 | 430 | 300 | CR |
| 4 | 875 | 200 | 280 | 15 | 480 | 410 | 210 | GA |
| 5 | 880 | 180 | 270 | 20 | 510 | 450 | 200 | CR |
| 6 | 890 | 120 | 275 | 30 | 480 | 460 | 200 | CR |
| 7 | 880 | 210 | 260 | 25 | 450 | 440 | 180 | GA |
| 8 | 870 | 160 | 285 | 50 | 470 | 430 | 250 | GI |
| 9 | 845 | 200 | 290 | 45 | 490 | 420 | 210 | CR |
| 10 | 865 | 5 | 250 | 35 | 500 | 410 | 280 | CR |
| 11 | 870 | 50 | 190 | 60 | 510 | 450 | 880 | EG |
| 12 | 875 | 300 | 350 | 40 | 490 | 460 | 240 | CR |
| 13 | 870 | 280 | 260 | 3 | 450 | 430 | 350 | GA |
| 14 | 870 | 250 | 270 | 30 | 370 | 410 | 500 | CR |
| 15 | 880 | 170 | 240 | 25 | 580 | 440 | 600 | CR |
| 16 | 870 | 150 | 250 | 15 | 480 | 370 | 240 | CR |
| 17 | 865 | 120 | 240 | 13 | 550 | 540 | 400 | GI |
| 18 | 870 | 270 | 245 | 20 | 490 | 410 | 5 | CR |
| 19 | 870 | 300 | 255 | 40 | 400 | 390 | 300 | GA |
| 20 | 860 | 220 | 285 | 55 | 420 | 400 | 400 | CR |
| 21 | 870 | 260 | 290 | 50 | 440 | 430 | 500 | GI |
| 22 | 880 | 180 | 285 | 20 | 500 | 440 | 450 | EG |
| 23 | 910 | 160 | 320 | 25 | 520 | 500 | 350 | CR |
| 24 | 860 | 230 | 270 | 15 | 440 | 410 | 220 | GA |
| 25 | 885 | 250 | 290 | 30 | 470 | 450 | 380 | GI |
| 26 | 850 | 240 | 265 | 35 | 480 | 460 | 440 | CR |
| 27 | 930 | 550 | 280 | 50 | 440 | 430 | 600 | CR |
| 28 | 900 | 190 | 295 | 55 | 490 | 440 | 210 | EG |
| 29 | 870 | 180 | 280 | 100 | 500 | 400 | 180 | GA |
| 30 | 880 | 260 | 270 | 20 | 530 | 500 | 100 | CR |
| 31 | 890 | 290 | 290 | 35 | 480 | 450 | 700 | GA |
| 32 | 870 | 70 | 255 | 40 | 470 | 410 | 320 | CF |
| 33 | 870 | 40 | 265 | 25 | 460 | 440 | 340 | GI |
| 34 | 860 | 220 | 280 | 15 | 470 | 450 | 200 | GI |
| 35 | 880 | 170 | 285 | 35 | 460 | 400 | 10 | GA |
| 36 | 890 | 150 | 290 | 40 | 410 | 410 | 90 | CR |
| 37 | 900 | 110 | 280 | 10 | 410 | 395 | 190 | EG |
| 38 | 880 | 230 | 275 | 25 | 450 | 430 | 200 | CR |
| 39 | 865 | 240 | 285 | 20 | 490 | 460 | 550 | GA |

Underlined portions: values are outside the range of the disclosed embodiments.

*CR cold-rolled steel sheet (uncoated),

GI galvanized steel sheet (without alloying treatment of zinc coating),

GA galvannealed steel sheet,

EG electrogalvanized steel sheet (Zn—Ni alloy coating)

TABLE 2-2

| | | Hot rolling | | | | | | Heat treatment of hot-rolled steel sheet | |
|---|---|---|---|---|---|---|---|---|---|
| No. | Type of steel | Finish rolling entry temperature (° C.) | Finish rolling delivery temperature (° C.) | Rolling reduction in a pass before a final pass of a finish rolling (%) | Rolling reduction in last pass of finish rolling (%) | Cooling temperature (° C.) | Cooling temperature after coiling (° C.) | Heat treatment temperature (° C.) | Heat treatment time (s) |
| 40 | Y | 1120 | 860 | 22 | 12 | 450 | 25 | — | — |
| 41 | Z | 1050 | 920 | 20 | 11 | 430 | 80 | 550 | 18000 |
| 42 | C | 1090 | 890 | 9 | 12 | 460 | 60 | 510 | 15000 |
| 43 | C | 1110 | 900 | 33 | 11 | 450 | 80 | 520 | 17000 |
| 44 | M | 1130 | 860 | 22 | 9 | 450 | 30 | 510 | 30000 |
| 45 | AB | 1070 | 930 | 18 | 10 | 490 | 40 | 500 | 15000 |
| 46 | AC | 1050 | 880 | 19 | 12 | 500 | 70 | 550 | 17000 |
| 47 | AD | 1110 | 910 | 20 | 9 | 470 | 50 | 570 | 28000 |
| 48 | AE | 1090 | 920 | 15 | 10 | 460 | 60 | 600 | 25000 |
| 49 | AF | 1080 | 890 | 23 | 10 | 480 | 80 | 580 | 23000 |
| 50 | AG | 1120 | 900 | 25 | 9 | 500 | 40 | 510 | 20000 |
| 51 | AH | 1060 | 870 | 22 | 12 | 440 | 50 | 520 | 18000 |
| 52 | Al | 1100 | 890 | 24 | 13 | 430 | 50 | 550 | 16000 |
| 53 | AJ | 1120 | 920 | 16 | 10 | 480 | 60 | 540 | 12000 |
| 54 | AK | 1090 | 910 | 17 | 12 | 450 | 80 | 510 | 10000 |
| 55 | AL | 1050 | 900 | 19 | 13 | 470 | 70 | 500 | 30000 |
| 56 | AM | 1070 | 880 | 20 | 9 | 500 | 30 | 540 | 29000 |
| 57 | AN | 1110 | 920 | 22 | 10 | 460 | 25 | 560 | 14000 |
| 58 | AO | 1060 | 860 | 23 | 10 | 440 | 200 | 550 | 21000 |
| 59 | AP | 1150 | 850 | 19 | 9 | 540 | 60 | 560 | 26000 |
| 60 | AQ | 1050 | 850 | 22 | 12 | 520 | 70 | 560 | 18000 |
| 61 | AR | 1060 | 910 | 20 | 10 | 580 | 50 | 510 | 16000 |
| 62 | AS | 1160 | 900 | 23 | 10 | 420 | 50 | 530 | 20000 |
| 63 | AT | 1060 | 860 | 19 | 11 | 560 | 40 | 590 | 11000 |
| 64 | AU | 1160 | 880 | 23 | 13 | 440 | 30 | — | — |
| 65 | AV | 1060 | 850 | 21 | 12 | 560 | 400 | 520 | 25000 |
| 66 | AW | 1060 | 910 | 22 | 11 | 560 | 25 | 520 | 16000 |
| 67 | AX | 1030 | 850 | 20 | 10 | 520 | 40 | 600 | 23000 |
| 68 | AY | 1160 | 920 | 21 | 7 | 470 | 50 | 530 | 30000 |
| 69 | C | 1100 | 890 | 23 | 3 | 460 | 70 | 530 | 20000 |
| 70 | C | 1130 | 900 | 20 | 19 | 450 | 80 | 510 | 15000 |

| | Annealing treatment | | | | | | | |
|---|---|---|---|---|---|---|---|---|
| No. | Heating temperature (° C.) | Holding time at heating temperature (s) | Cooling stop temperature (° C.) | Average heating rate from cooling stop temperature to reheating temperature (° C./s) | Reheating temperature (° C.) | Holding temperature (° C.) | Holding time at holding temperature (s) | Type* |
| 40 | 870 | 140 | 275 | 50 | 480 | 390 | 280 | GI |
| 41 | 880 | 190 | 290 | 35 | 510 | 470 | 170 | CR |
| 42 | 860 | 90 | 285 | 20 | 480 | 430 | 180 | CR |
| 43 | 875 | 120 | 270 | 30 | 470 | 420 | 220 | CR |
| 44 | 880 | 200 | 290 | 30 | 450 | 410 | 210 | CR |
| 45 | 900 | 180 | 290 | 45 | 490 | 430 | 260 | CR |
| 46 | 870 | 60 | 270 | 12 | 480 | 400 | 180 | CR |
| 47 | 880 | 50 | 275 | 55 | 460 | 410 | 300 | CR |
| 48 | 875 | 300 | 260 | 45 | 420 | 395 | 450 | CR |
| 49 | 880 | 250 | 250 | 60 | 440 | 410 | 360 | CR |
| 50 | 885 | 270 | 270 | 35 | 500 | 450 | 120 | CR |
| 51 | 880 | 210 | 285 | 50 | 530 | 470 | 200 | CR |
| 52 | 860 | 130 | 280 | 40 | 460 | 390 | 180 | CR |
| 53 | 890 | 120 | 250 | 25 | 470 | 420 | 420 | CR |
| 54 | 855 | 90 | 240 | 15 | 470 | 410 | 350 | CR |
| 55 | 870 | 150 | 255 | 30 | 480 | 400 | 150 | CR |
| 56 | 875 | 200 | 280 | 50 | 440 | 420 | 80 | CR |
| 57 | 860 | 230 | 290 | 35 | 500 | 430 | 120 | CR |
| 58 | 875 | 270 | 240 | 25 | 480 | 450 | 100 | CR |
| 59 | 880 | 160 | 255 | 35 | 530 | 440 | 340 | CR |
| 60 | 870 | 240 | 275 | 25 | 470 | 450 | 10 | CR |
| 61 | 910 | 180 | 280 | 35 | 490 | 450 | 190 | CR |
| 62 | 930 | 290 | 290 | 30 | 460 | 410 | 550 | CR |
| 63 | 870 | 40 | 290 | 45 | 410 | 395 | 210 | CR |
| 64 | 870 | 170 | 285 | 55 | 490 | 460 | 180 | CR |

TABLE 2-2-continued

| | | | | | | | | |
|---|---|---|---|---|---|---|---|---|
| 65 | 880 | 110 | 275 | 60 | 510 | 420 | 450 | CR |
| 66 | 940 | 240 | 280 | 35 | 490 | 430 | 360 | CR |
| 67 | 900 | 190 | 290 | 40 | 460 | 440 | 200 | CR |
| 68 | 875 | 180 | 260 | 25 | 420 | 395 | 120 | CR |
| 69 | 870 | 150 | 270 | 20 | 480 | 420 | 200 | CR |
| 70 | 875 | 120 | 280 | 35 | 490 | 430 | 180 | CR |

Underlined portions: values are outside the range of the disclosed embodiments.
*CR cold-rolled steel sheet (uncoated),
GI galvanized steel sheet (without alloying treatment of zinc coating),
GA galvannealed steel sheet,
EG electrogalvanized steel sheet (Zn—Ni alloy coating)

The high-strength cold-rolled steel sheets and the high-strength coated steel sheets obtained as described above were used as steel samples for evaluation of mechanical characteristics. The mechanical characteristics were evaluated by performing the quantitative evaluation of constituent microstructures of the steel sheets and a tensile test described below. Tables 3-1 and 3-2 present the results.

Area Percentage of Structure with Respect to Entire Microstructure of Steel Sheet A method for measuring area percentages of tempered martensite, fresh martensite, and bainite is as follows: A test piece was cut out from each steel sheet in such a manner that a section of the test piece in the sheet-thickness direction, the section being parallel to the rolling direction, was an observation surface. The observation surface was subjected to mirror polishing with a diamond paste, final polishing with colloidal silica, and etching with 3% by volume nital to expose the microstructure. Three fields of view, each measuring 17μ×23 μm, were observed with a scanning electron microscope (SEM) equipped with an in-lens detector at an acceleration voltage of 1 kV and a magnification of ×5,000. From the resulting microstructure images, area percentages obtained by dividing areas of constituent structures (the tempered martensite, the fresh martensite, and the bainite) by a measured area were calculated for the three fields of view using Adobe Photoshop available from Adobe Systems Inc. The resultant values were averaged to determine the area percentage of each structure. In the microstructure images, the tempered martensite is a base structure that appears as a recessed portion and that contains fine carbide. The fresh martensite is a structure that appears as a protruding portion and that has fine irregularities therein. The bainite is a structure that appears as a recessed portion and that is flat therein. In Tables 3-1 and 3-2, the area percentage of the tempered martensite determined here is presented as the "Area percentage of TM", the area percentage of the fresh martensite determined here is presented as the "Area percentage of FM", and the area percentage of the bainite determined here is presented as the "Area percentage of B".

Area Percentage of Retained Austenite

The area percentage of retained austenite was determined as follows: Each steel sheet was ground and polished in the thickness direction so as to have a thickness of ¼ of the original thickness thereof, and then was subjected to X-ray diffraction measurement. Co—Kα was used as an incident X-ray. The retained austenite content was calculated from ratios of diffraction intensities of the (200), (220), and (311) planes of austenite by an integrated intensity method to those of (200) and (211) planes of ferrite by the integrated intensity method. The retained austenite content determined here is presented as the "Area percentage of RA" in Tables 3-1 and 3-2.

Average Grain Size of Retained Austenite

A method for measuring the average grain size of the retained austenite is as follows: A test piece is cut out in such a manner that a section of the test piece in the sheet-thickness direction of each steel sheet, the section being parallel to the rolling direction, is an observation surface. The observation surface is subjected to mirror polishing with a diamond paste, final polishing with colloidal silica, and etching with 3% by volume nital to expose the microstructure. Three fields of view, each measuring 17 μm×23 μm, are observed with a SEM equipped with an in-lens detector at an acceleration voltage of 1 kV and a magnification of ×5,000. From the resulting microstructure images, the average grain sizes of the retained austenite are calculated for the three fields of view using Adobe Photoshop available from Adobe Systems Inc. The resultant values are averaged to determine the average grain size of the retained austenite. In the microstructure images, the retained austenite is a structure that appears as a protruding portion and that is flat therein. The average grain size of the retained austenite determined here is presented as the "Average grain size of RA" in Tables 3-1 and 3-2.

Hardness Ratio of Fresh Martensite to Tempered Martensite

The hardness ratio of the fresh martensite to the tempered martensite was determined as follows: A rolled surface of each steel sheet was subjected to grinding, mirror polishing, and then electropolishing with perchloric acid alcohol. The hardness values of each of the tempered martensite and the fresh martensite were measured at five points at a ¼-thickness position (a position corresponding to ¼ of the sheet thickness from the surface of the steel sheet in the depth direction) with a nanoindenter (TI-950 Tribolndenter, available from Hysitron) at a load of 250 μN. The average hardness of each structure was then determined. The hardness ratio was calculated from the average hardness of each structure determined here. The ratio of the average hardness of the fresh martensite to the average hardness of the tempered martensite determined here is presented as the "Hardness ratio of FM to TM" in Tables 3-1 and 3-2.

KAM Value

A section (L-section) of each steel sheet in the sheet-thickness direction, the section being parallel to the rolling direction, was smoothed by wet polishing and buffing with a colloidal silica solution to smooth the surface. Then the section was etched with 0.1% by volume nital to minimize the irregularities on the surface of the test piece and to completely remove an affected layer. The crystal orientations were measured at a ¼-thickness position (a position corresponding to ¼ of the sheet thickness from the surface of the steel sheet in the depth direction) by a SEM-electron back-scatter diffraction (EBSD) method using a step size of 0.05 μm. The original data sets of the crystal orientations were subjected to a clean-up procedure once using a grain dilation algorithm (grain tolerance angle: 5, minimum grain size: 2) with OIM Analysis available from AMETEK EDAX. The KAM values were determined by setting a confidence index (CI) >0.1, a grain size (GS) >0.2, and IQ >200 as threshold values. The kernel average misorientation (KAM) value used here indicates the numerical average misorientation of a measured pixel with the first nearest neighbor pixels.

Average KAM Value in Tempered Martensite

The average KAM value in the tempered martensite was determined by averaging KAM values in the tempered martensite adjoining the fresh martensite.

Maximum KAM Value in Tempered Martensite in Vicinity of Heterophase Interface Between Tempered Martensite and Fresh Martensite The maximum KAM value in the tempered martensite in the vicinity of a heterophase interface between the tempered martensite and the fresh martensite is the maximum value of the KAM values in a region of the tempered martensite extending from the heterophase interface between the tempered martensite and the adjoining fresh martensite to a position 0.2 μm away from the heterophase interface.

As described above, the average KAM value in the tempered martensite and the maximum KAM value in the tempered martensite in the vicinity of the heterophase interface between the tempered martensite and the fresh martensite were determined. Their ratio was defined as the ratio of the maximum KAM value in the tempered martensite in the vicinity of the heterophase interface between the tempered martensite and the fresh martensite to the average KAM value in the tempered martensite. The ratio is presented in Tables 3-1 and 3-2.

Grain Size of Prior Austenite Grain

The grain size of the prior austenite grains was determined as follows: A test piece was cut out from each steel sheet in such a manner that a section of the test piece in the sheet-thickness direction, the section being parallel to the rolling direction, was an observation surface. The observation surface was subjected to mirror polishing with a diamond paste and then etching with an etchant containing a saturated aqueous solution of picric acid to which sulfonic acid, oxalic acid, and ferrous chloride were added, thereby exposing the prior austenite grains. Three fields of view were observed with an optical microscope at a magnification of ×400, each of the fields of view measuring 169 μm×225 μm. From the resulting microstructure images, the ratios of grain sizes of the prior austenite grains in the rolling direction to those in the thickness direction were calculated for three fields of view using Adobe Photoshop available from Adobe Systems Inc. The resultant values are averaged to determine the grain size of the prior austenite grains. The ratio of the grain size of the prior austenite grains in the rolling direction to that in the thickness direction (aspect ratio) determined here is presented as the "Ratio of grain size of prior A grain in rolling direction to that in thickness direction" in Tables 3-1 and 3-2.

Mechanical Characteristics

A method for measuring the mechanical characteristics (tensile strength TS, yield stress YS, and total elongation El) is as follows: To measure the yield stress (YS), the tensile strength (TS), and the total elongation (El), a tensile test was performed in accordance with JIS Z 2241(2011) using JIS No. 5 test pieces that were sampled in such a manner that the longitudinal direction of each test piece coincided with three directions: the rolling direction of the steel sheet (L-direction), a direction (D-direction) forming an angle of 45° with respect to the rolling direction of the steel sheet, and a direction (C-direction) perpendicular to the rolling direction of the steel sheet. The product of the tensile strength and the total elongation (TS×El) was calculated to evaluate the balance between the strength and workability (ductility). In the disclosed embodiments, the term "good ductility", i.e., "good total elongation (El)", indicates that the value of TS×El was 16,500 MPa·% or more, which was evaluated as good. The term "good controllability of YS" indicates that the value of the yield ratio YR=(YS/TS)×100, which serves as an index of the controllability of YS, was 65% or more and 95% or less, which was evaluated as good. The term "good in-plane anisotropy of YS" indicates that the value of |ΔYS|, which serves as an index of the in-plane anisotropy of YS, was 50 MPa or less, which was evaluated as good. YS, TS, and El determined from the measurement results of the test pieces taken in the C-direction are presented in Tables 3-1 and 3-2. |ΔYS| was calculated from the calculation method described above.

A hole expanding test was performed in accordance with JIS Z 2256(2010). Each of the resulting steel sheets was cut into a piece measuring 100 mm×100 mm. A hole having a diameter of 10 mm was formed in the piece by punching at a clearance of 12%±1%. A cone punch with a 60° apex was forced into the hole while the piece was fixed with a die having an inner diameter of 75 mm at a blank-holding pressure of 9 tons (88.26 kN). The hole diameter at the crack initiation limit was measured. The critical hole-expansion ratio X (%) was determined from a formula described below. The hole expansion formability was evaluated on the basis of the value of the critical hole-expansion ratio.

$$\text{Critical hole-expansion ratio } \lambda(\%)=\{(D_f-D_0)/D_0\}\times 100$$

where $D_f$ is the hole diameter (mm) when a crack is initiated, and $D_0$ is the initial hole diameter (mm). The term "good stretch-flangeability" used in the disclosed embodiments indicates that regardless of the strength of the steel sheet, the value of λ, which serves as an index of the stretch-flangeability, is 30% or more, which is rated as good.

The residual microstructure was also examined in a general way and presented in Tables 3-1 and 3-2.

TABLE 3-1

| No. | Type of steel | Area percentage TM (%) | Area of percentage of FM (%) | Area percentage of B (%) | Area percentage of RA (%) | Average grain size of RA (μm) | Hardness Ratio of FM to TM | Ratio of maximum KAM value in TM in vicinity of heterophase interface between TM and FM to average KAM value in TM | Ratio of grain size of prior A grain in rolling direction to that in thickness direction |
|---|---|---|---|---|---|---|---|---|---|
| 1 | A | 82.3 | 5.2 | 0.4 | 11.5 | 0.7 | 2.7 | 17.7 | 1.2 |
| 2 | B | 83.2 | 5.3 | 0.8 | 10.5 | 1.2 | 2.9 | 17.4 | 1.2 |

TABLE 3-1-continued

| | | | | | | | | | |
|---|---|---|---|---|---|---|---|---|---|
| 3 | C | 76.8 | 8.8 | 0.9 | 10.5 | 1.3 | 2.3 | 7.4 | 0.8 |
| 4 | C | 80.4 | 5.1 | 3.2 | 11.0 | 1.5 | 2.1 | 8.6 | 2.7 |
| 5 | C | 80.7 | 5.2 | 3.8 | 9.1 | 1.4 | 1.9 | 6.2 | 3.5 |
| 6 | C | 81.9 | 4.4 | 3.2 | 10.3 | 1.4 | 2.0 | 7.6 | 2.6 |
| 7 | C | 80.8 | 5.1 | 2.9 | 10.5 | 1.1 | 2.2 | 7.1 | 3.1 |
| 8 | C | 81.2 | 5.8 | 3.0 | 9.7 | 0.5 | 2.1 | 4.0 | 2.6 |
| 9 | C | 67.5 | 8.2 | 2.2 | 9.5 | 0.6 | 3.9 | 13.0 | 0.8 |
| 10 | C | 70.5 | 5.9 | 2.0 | 10.7 | 1.3 | 3.7 | 19.4 | 3.1 |
| 11 | C | 93.6 | 3.2 | 0.0 | 1.4 | 0.1 | 1.4 | 1.0 | 1.0 |
| 12 | C | 65.3 | 26.5 | 0.3 | 7.3 | 0.6 | 3.8 | 15.3 | 1.0 |
| 13 | C | 74.2 | 1.7 | 11.9 | 12.1 | 1.0 | 1.9 | 2.7 | 1.2 |
| 14 | C | 73.8 | 1.9 | 10.9 | 12.1 | 1.0 | 1.9 | 5.0 | 1.0 |
| 15 | C | 85.4 | 2.0 | 0.0 | 2.1 | 0.1 | 2.0 | 5.4 | 1.4 |
| 16 | C | 81.3 | 8.7 | 1.4 | 7.8 | 1.1 | 1.2 | 1.2 | 0.8 |
| 17 | C | 82.4 | 3.1 | 0.0 | 2.8 | 0.1 | 2.4 | 7.0 | 1.0 |
| 18 | C | 81.2 | 5.9 | 0.6 | 12.0 | 0.8 | 1.1 | 1.3 | 0.9 |
| 19 | D | 83.5 | 6.1 | 0.5 | 9.9 | 0.6 | 2.5 | 10.9 | 0.9 |
| 20 | E | 82.2 | 6.6 | 0.0 | 9.6 | 1.1 | 2.6 | 10.4 | 1.9 |
| 21 | F | 82.5 | 3.2 | 4.8 | 8.6 | 0.4 | 1.5 | 1.8 | 1.6 |
| 22 | G | 82.0 | 5.0 | 4.7 | 8.3 | 0.4 | 1.7 | 2.1 | 1.6 |
| 23 | H | 80.3 | 1.3 | 11.3 | 7.0 | 0.5 | 1.2 | 6.6 | 1.3 |
| 24 | I | 82.9 | 1.1 | 11.9 | 2.5 | 0.4 | 1.2 | 5.5 | 1.4 |
| 25 | J | 69.3 | 1.6 | 17.4 | 7.9 | 0.5 | 1.6 | 2.2 | 0.9 |
| 26 | K | 70.9 | 20.6 | 0.7 | 7.2 | 0.8 | 2.6 | 13.1 | 2.6 |
| 27 | L | 79.4 | 1.0 | 8.7 | 10.6 | 1.3 | 1.8 | 1.6 | 1.3 |
| 28 | M | 75.8 | 2.8 | 9.8 | 11.0 | 1.4 | 1.6 | 2.3 | 1.3 |
| 29 | N | 78.0 | 13.3 | 0.6 | 7.2 | 0.8 | 2.5 | 13.9 | 1.4 |
| 30 | O | 85.3 | 4.9 | 0.0 | 8.3 | 0.3 | 2.3 | 8.2 | 1.1 |
| 31 | P | 82.2 | 2.9 | 2.4 | 12.2 | 1.0 | 2.8 | 13.7 | 1.4 |
| 32 | Q | 80.4 | 9.1 | 1.3 | 9.2 | 1.2 | 2.2 | 3.2 | 1.1 |
| 33 | R | 78.1 | 7.7 | 1.8 | 11.3 | 1.2 | 2.7 | 15.8 | 0.9 |
| 34 | S | 81.4 | 7.1 | 0.8 | 10.6 | 0.6 | 2.0 | 4.1 | 1.3 |
| 35 | T | 83.8 | 6.2 | 1.1 | 8.8 | 0.7 | 1.7 | 2.5 | 1.1 |
| 36 | U | 81.9 | 1.7 | 2.6 | 13.4 | 2.0 | 2.5 | 10.9 | 1.7 |
| 37 | V | 80.5 | 1.9 | 4.7 | 11.4 | 1.1 | 15 | 2.1 | 1.2 |
| 38 | W | 81.7 | 6.9 | 0.8 | 9.8 | 1.1 | 2.7 | 16.4 | 1.2 |
| 39 | X | 84.0 | 1.9 | 5.5 | 7.4 | 0.4 | 1.7 | 1.8 | 2.0 |

| No. | Residual micro-structure | YS (MPa) | TS (MPa) | YR (%) | EI (%) | TS × EI (MPa · %) | λ (%) | \|ΔYS\| (MPa) | Remarks |
|---|---|---|---|---|---|---|---|---|---|
| 1 | θ | 974 | 1283 | 76 | 14.8 | 18988 | 33 | 27 | Example |
| 2 | θ | 1014 | 1307 | 78 | 14.5 | 18952 | 31 | 24 | Example |
| 3 | θ | 978 | 1227 | 80 | 15.2 | 18650 | 48 | 40 | Example |
| 4 | θ | 1029 | 1233 | 83 | 12.0 | 14796 | 21 | 72 | Comparative example |
| 5 | θ | 1007 | 1212 | 83 | 12.9 | 15635 | 25 | 32 | Comparative example |
| 6 | θ | 1024 | 1250 | 82 | 11.7 | 14625 | 23 | 61 | Comparative example |
| 7 | θ | 1026 | 1231 | 83 | 12.6 | 15511 | 28 | 26 | Comparative example |
| 8 | θ | 958 | 1219 | 79 | 15.1 | 18407 | 53 | 60 | Comparative example |
| 9 | F + θ | 769 | 1246 | 62 | 14.6 | 18192 | 21 | 39 | Comparative example |
| 10 | F + θ | 772 | 1225 | 63 | 14.8 | 18130 | 22 | 18 | Comparative example |
| 11 | θ | 1273 | 1301 | 98 | 11.3 | 14701 | 70 | 30 | Comparative example |
| 12 | θ | 777 | 1246 | 62 | 16.4 | 20434 | 27 | 25 | Comparative example |
| 13 | θ | 1184 | 1209 | 98 | 16.5 | 19949 | 56 | 31 | Comparative example |
| 14 | θ | 1165 | 1211 | 96 | 15.0 | 18165 | 49 | 38 | Comparative example |

TABLE 3-1-continued

| | | | | | | | | | |
|---|---|---|---|---|---|---|---|---|---|
| 15 | P + θ | 1140 | 1171 | 97 | 12.5 | 14638 | 60 | 27 | Comparative example |
| 16 | θ | 1262 | 1309 | 96 | 11.4 | 14923 | 50 | 41 | Comparative example |
| 17 | P + θ | 1144 | 1166 | 98 | 12.2 | 14225 | 42 | 35 | Comparative example |
| 18 | θ | 1249 | 1294 | 97 | 13.4 | 17340 | 54 | 21 | Comparative example |
| 19 | θ | 884 | 1248 | 71 | 15.1 | 18845 | 37 | 28 | Example |
| 20 | θ | 933 | 1275 | 73 | 13.2 | 16830 | 46 | 46 | Example |
| 21 | θ | 1034 | 1199 | 86 | 13.8 | 16546 | 31 | 36 | Example |
| 22 | θ | 1065 | 1193 | 89 | 15.8 | 18849 | 43 | 50 | Example |
| 23 | θ | 1143 | 1175 | 97 | 13.5 | 15863 | 63 | 43 | Comparative example |
| 24 | θ | 1178 | 1206 | 98 | 13.2 | 15919 | 47 | 32 | Comparative example |
| 25 | F + θ | 1140 | 1173 | 97 | 12.4 | 14545 | 47 | 26 | Comparative example |
| 26 | θ | 792 | 1267 | 63 | 12.3 | 15584 | 47 | 70 | Comparative example |
| 27 | θ | 1039 | 1186 | 88 | 17.5 | 20755 | 40 | 23 | Example |
| 28 | θ | 1048 | 1189 | 88 | 14.0 | 16646 | 51 | 21 | Example |
| 29 | θ | 871 | 1217 | 72 | 16.2 | 19715 | 38 | 34 | Example |
| 30 | θ | 1044 | 1182 | 88 | 14.1 | 16666 | 54 | 39 | Example |
| 31 | θ | 869 | 1185 | 73 | 16.9 | 20027 | 39 | 43 | Example |
| 32 | θ | 966 | 1235 | 78 | 14.8 | 18278 | 49 | 37 | Example |
| 33 | F + θ | 867 | 1238 | 70 | 14.2 | 17580 | 46 | 41 | Example |
| 34 | θ | 1011 | 1220 | 83 | 14.0 | 17080 | 45 | 44 | Example |
| 35 | θ | 1116 | 1276 | 87 | 13.1 | 16716 | 65 | 33 | Example |
| 36 | θ | 980 | 1264 | 78 | 14.6 | 18454 | 49 | 47 | Example |
| 37 | θ | 1009 | 1185 | 85 | 14.2 | 16827 | 65 | 26 | Example |
| 38 | θ | 914 | 1248 | 73 | 14.1 | 17597 | 40 | 19 | Example |
| 39 | θ | 1048 | 1197 | 88 | 14.3 | 17117 | 55 | 45 | Example |

Underlined portions: values are outside the range of the disclosed embodiments.
TM tempered martensite,
FM fresh martensite,
B bainite,
RA retained austenite,
A austenite,
F ferrite,
P pearlite,
θ cementite

TABLE 3-2

| No. | Type of steel | Area percentage TM (%) | Area of percentage of FM (%) | Area percentage of B (%) | Area percentage of RA (%) | Average grain size of RA (μm) | Hardness Ratio of FM to TM | Ratio of maximum KAM value in TM in vicinity of heterophase interface between TM and FM to average KAM value in TM | Ratio of grain size of prior A grain in rolling direction to that in thickness direction |
|---|---|---|---|---|---|---|---|---|---|
| 40 | Y | 81.4 | 6.7 | 1.3 | 9.6 | 0.9 | 2.7 | 13.6 | 1.5 |
| 41 | Z | 82.3 | 3.0 | 5.8 | 7.3 | 0.5 | 1.8 | 2.4 | 0.8 |
| 42 | C | 81.3 | 6.2 | 3.3 | 8.8 | 0.9 | 1.9 | 5.8 | 2.0 |
| 43 | C | 82.7 | 1.8 | 8.2 | 7.0 | 0.7 | 2.2 | 1.5 | 1.1 |
| 44 | AA | 79.6 | 7.6 | 1.4 | 11.0 | 0.5 | 2.1 | 6.6 | 1.0 |
| 45 | AB | 78.3 | 8.0 | 2.0 | 11.6 | 0.9 | 2.1 | 9.4 | 1.3 |
| 46 | AC | 78.6 | 9.8 | 1.2 | 9.7 | 0.6 | 2.1 | 8.6 | 1.1 |
| 47 | AD | 82.5 | 6.4 | 0.5 | 9.2 | 1.1 | 2.2 | 6.2 | 1.3 |
| 48 | AE | 79.3 | 9.5 | 0.8 | 9.6 | 0.7 | 2.4 | 6.8 | 1.3 |
| 49 | AF | 80.6 | 7.0 | 1.4 | 10.2 | 0.6 | 2.3 | 3.1 | 1.5 |
| 50 | AG | 81.5 | 5.2 | 1.8 | 11.0 | 0.7 | 2.1 | 7.4 | 1.3 |
| 51 | AH | 81.2 | 8.5 | 1.1 | 9.1 | 1.0 | 2.3 | 8.7 | 0.8 |
| 52 | Al | 79.2 | 8.8 | 1.9 | 9.0 | 1.4 | 1.9 | 5.1 | 1.0 |
| 53 | AJ | 80.5 | 7.5 | 1.9 | 9.6 | 1.4 | 2.0 | 4.6 | 1.4 |

TABLE 3-2-continued

| | | | | | | | | | |
|---|---|---|---|---|---|---|---|---|---|
| 54 | AK | 79.0 | 9.9 | 0.5 | 10.0 | 1.4 | 1.9 | 9.1 | 0.9 |
| 55 | AL | 79.9 | 8.4 | 1.4 | 9.9 | 0.7 | 2.2 | 3.2 | 0.9 |
| 56 | AM | 83.6 | 5.0 | 0.9 | 10.3 | 0.7 | 2.2 | 5.8 | 1.4 |
| 57 | AN | 81.5 | 6.3 | 1.1 | 9.5 | 0.7 | 2.0 | 6.4 | 1.3 |
| 58 | AO | 78.1 | 2.9 | 9.8 | 8.8 | 0.3 | 2.0 | 10.9 | 1.3 |
| 59 | AP | 80.8 | 7.1 | 1.3 | 9.6 | 0.7 | 2.5 | 1.8 | 1.4 |
| 60 | AQ | 85.6 | 1.9 | 0.8 | 11.0 | 1.1 | 1.6 | 2.4 | 1.3 |
| 61 | AR | 79.8 | 6.1 | 4.6 | 9.2 | 0.9 | 2.2 | 9.4 | 1.1 |
| 62 | AS | 79.4 | 6.7 | 3.2 | 10.2 | 0.9 | 2.0 | 6.2 | 1.2 |
| 63 | AT | 78.6 | 9.5 | 2.0 | 9.6 | 0.6 | 2.7 | 6.8 | 1.5 |
| 64 | AU | 81.3 | 7.8 | 0.0 | 10.0 | 0.7 | 2.7 | 7.4 | 1.0 |
| 65 | AV | 79.2 | 8.8 | 1.4 | 10.3 | 0.6 | 2.1 | 4.6 | 1.3 |
| 66 | AW | 80.4 | 7.9 | 1.1 | 9.5 | 1.0 | 2.1 | 9.1 | 1.5 |
| 67 | AX | 79.0 | 7.4 | 1.9 | 11.4 | 1.4 | 2.1 | 5.8 | 0.8 |
| 68 | AY | 83.6 | 6.3 | 1.4 | 7.4 | 0.7 | 2.0 | 4.1 | 1.0 |
| 69 | C | 88.2 | 9.3 | 1.7 | 11.8 | 1.4 | 2.1 | 3.7 | 1.3 |
| 70 | C | 87.9 | 6.8 | 1.1 | 8.1 | 0.6 | 1.6 | 2.5 | 1.9 |

| No. | Residual microstructure | YS (MPa) | TS (MPa) | YR (%) | El (%) | TS × El (MPa · %) | λ (%) | \|ΔYS\| (MPa) | Remarks |
|---|---|---|---|---|---|---|---|---|---|
| 40 | θ | 913 | 1262 | 72 | 15.4 | 19435 | 35 | 33 | Example |
| 41 | θ | 913 | 1242 | 74 | 14.2 | 17636 | 35 | 30 | Example |
| 42 | θ | 991 | 1224 | 81 | 14.4 | 17626 | 48 | 49 | Example |
| 43 | θ | 1227 | 1292 | 95 | 12.8 | 16538 | 44 | 25 | Example |
| 44 | θ | 951 | 1217 | 78 | 15.6 | 18985 | 44 | 43 | Example |
| 45 | θ | 997 | 1223 | 82 | 15.5 | 18957 | 47 | 27 | Example |
| 46 | θ | 1016 | 1218 | 83 | 14.3 | 17417 | 53 | 34 | Example |
| 47 | θ | 967 | 1233 | 78 | 14.9 | 18372 | 50 | 22 | Example |
| 48 | θ | 1008 | 1244 | 81 | 14.4 | 17914 | 42 | 37 | Example |
| 49 | θ | 990 | 1209 | 82 | 14.6 | 17651 | 54 | 25 | Example |
| 50 | θ | 1012 | 1254 | 81 | 13.9 | 17431 | 50 | 30 | Example |
| 51 | θ | 953 | 1204 | 79 | 15.6 | 18782 | 44 | 33 | Example |
| 52 | θ | 1007 | 1209 | 83 | 15.7 | 18981 | 53 | 21 | Example |
| 53 | θ | 1015 | 1223 | 83 | 15.0 | 18345 | 45 | 39 | Example |
| 54 | θ | 1016 | 1249 | 81 | 13.8 | 17236 | 48 | 24 | Example |
| 55 | θ | 1019 | 1254 | 81 | 15.4 | 19312 | 46 | 45 | Example |
| 56 | θ | 1023 | 1226 | 83 | 15.3 | 18758 | 49 | 30 | Example |
| 57 | θ | 1007 | 1244 | 81 | 14.6 | 18162 | 49 | 24 | Example |
| 58 | θ | 882 | 1213 | 73 | 16.1 | 19529 | 33 | 35 | Example |
| 59 | θ | 1146 | 1296 | 88 | 14.6 | 18922 | 54 | 36 | Example |
| 60 | θ | 879 | 1196 | 73 | 14.2 | 16983 | 45 | 26 | Example |
| 61 | θ | 911 | 1232 | 74 | 14.2 | 17494 | 49 | 23 | Example |
| 62 | θ | 1119 | 1215 | 92 | 15.0 | 18225 | 65 | 34 | Example |
| 63 | θ | 1003 | 1233 | 81 | 15.9 | 19605 | 55 | 43 | Example |
| 64 | θ | 916 | 1226 | 75 | 14.2 | 17409 | 35 | 41 | Example |
| 65 | θ | 953 | 1262 | 76 | 13.6 | 17163 | 31 | 47 | Example |
| 66 | θ | 994 | 1194 | 83 | 15.2 | 18149 | 47 | 45 | Example |
| 67 | θ | 962 | 1268 | 76 | 15.5 | 19654 | 50 | 30 | Example |
| 68 | θ | 975 | 1214 | 80 | 14.7 | 17846 | 54 | 27 | Example |
| 69 | θ | 962 | 1224 | 79 | 14.1 | 17258 | 49 | 50 | Example |
| 70 | θ | 1198 | 1278 | 94 | 13.2 | 16870 | 65 | 45 | Example |

Underlined portions: values are outside the range of the disclosed embodiments.
TM tempered martensite,
FM fresh martensite,
B bainite,
RA retained austenite,
A austenite,
F ferrite,
P pearlite,
θ cementite As is clear from Tables 3-1 and 3-2, in these examples, TS is 1,180 MPa or more, the value of TS×El is 16,500 MPa·% or more, the value of λ is 30% or more, the value of YR is 65% or more and 95% or less, and the value of |ΔYS| is 50 MPa or less. That is, the high-strength steel sheets having good ductility, good stretch-flangeability, good controllability of the yield stress, and good in-plane anisotropy of the yield stress are provided. In contrast, in the steel sheets of comparative examples, which are outside the scope of the disclosed embodiments, as is clear from the examples, one or more of the tensile strength, the ductility, the stretch-flangeability, the controllability of the yield stress, and the in-plane anisotropy of the yield stress cannot satisfy the target performance.

Although some embodiments of the disclosed embodiments have been described above, the disclosed embodiments are not limited by the description that forms part of the present disclosure in relation to the embodiments. That is, a person skilled in the art may make various modifications to the embodiments, examples, and operation techniques disclosed herein, and all such modifications will still fall within the scope of the disclosed embodiments. For example, in the above-described series of heat treatment processes in the production method disclosed herein, any apparatus or the like may be used to perform the processes on the steel sheet as long as the thermal hysteresis conditions are satisfied.

The invention claimed is:

1. A steel sheet having a chemical composition comprising, by mass %:

C: 0.08% or more and 0.35% or less,
Si: 0.50% or more and 2.50% or less,
Mn: 2.00% or more and 3.50% or less,
P: 0.001% or more and 0.100% or less,
S: 0.0200% or less,
Al: 0.010% or more and 1.000% or less,
N: 0.0005% or more and 0.0100% or less, and
the balance being Fe and incidental impurities, wherein the steel sheet has a microstructure comprising, by area fraction, 75.0% or more tempered martensite, in a range of 1.0% or more and 20.0% or less fresh martensite, and in a range of 5.0% or more and 20.0% or less retained austenite, a hardness ratio of the fresh martensite to the tempered martensite is in a range of 1.5 or more and 3.0 or less, a ratio of a maximum kernel average misorientation (KAM) value in the tempered martensite in a vicinity of a heterophase interface between the tempered martensite and the fresh martensite to an average KAM value in the tempered martensite is in a range of 1.5 or more and 30.0 or less, and an average of ratios of grain sizes of prior austenite grains in a rolling direction to those in a thickness direction is 2.0 or less.

2. The steel sheet according to claim 1, wherein the steel microstructure further comprises, by area fraction, 10.0% or less bainite, and the retained austenite has an average grain size in a range of 0.2 μm or more and 5.0 μm or less.

3. The steel sheet according to claim 1, wherein the chemical composition further comprises, by mass %, at least one selected from the group consisting of:

Ti: 0.001% or more and 0.100% or less,
Nb: 0.001% or more and 0.100% or less,
V: 0.001% or more and 0.100% or less,
B: 0.0001% or more and 0.0100% or less,
Mo: 0.01% or more and 0.50% or less,
Cr: 0.01% or more and 1.00% or less,
Cu: 0.01% or more and 1.00% or less,
Ni: 0.01% or more and 0.50% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

4. The steel sheet according to claim 1, further comprising a coated layer disposed on a surface of the steel sheet.

5. A method for producing the steel sheet according to claim 3, the method comprising, in sequence:

heating steel;

performing hot rolling at a finish rolling entry temperature in a range of 1,020° C. or higher and 1,180° C. or lower and a finish rolling delivery temperature in a range of 800° C. or higher and 1,000° C. or lower;

performing coiling at a coiling temperature of 600° C. or lower;

performing cold rolling; and performing annealing by letting a temperature defined by formula (1) be temperature T1 (° C.) and letting a temperature defined by formula (2) be temperature T2 (° C.):

$$\text{temperature } T1(^\circ\text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+400\times[\%\ \text{Ti}] \quad (1)$$

where [% X] indicates the component element X content (% by mass) of steel and is 0 if X is not contained, and $$\text{temperature } T2(^\circ\text{C.})=560-566\times[\%\ \text{C}]-150\times[\%\ \text{C}]\times[\%\ \text{Mn}]-7.5\times[\%\ \text{Si}]+15\times[\%\ \text{Cr}]-67.6\times[\%\ \text{C}]\times[\%\ \text{Cr}] \quad (2)$$

where [% X] indicates the component element X content (% by mass) of steel and is 0 if X is not contained, wherein the annealing includes, in sequence:

retaining heat at a heating temperature equal to or higher than temperature T1 for 10s or more, performing cooling to a cooling stop temperature in a range of 220° C. or higher and ((220° C.+temperature T2)/2) or lower, performing reheating from the cooling stop temperature to a reheating temperature of A or higher and 560° C. or lower, where A is a freely-selected temperature (° C.) that satisfies (temperature T2+20° C.)≤A≤530° C.) at an average heating rate of 10° C./s or more, and performing holding at the temperature A for 10s or more.

6. The method for producing the steel sheet according to claim 5, wherein a rolling reduction in a pass before a final pass of a finish rolling in the hot rolling is in a range of 15% or more and 25% or less.

7. The method for producing the steel sheet according to claim 5, wherein a heat treatment is performed after the coiling and before the cold rolling, and the heat treatment includes performing cooling from the coiling temperature to 200° C. or lower, performing reheating, and performing holding in a temperature range of 450° C. to 650° C. for 900s or more.

8. The method for producing the steel sheet according to claim 7, wherein a coating treatment is performed after the annealing.

9. The steel sheet according to claim 2, wherein the chemical composition further comprises, by mass %, at least one selected from the group consisting of:

Ti: 0.001% or more and 0.100% or less,
Nb: 0.001% or more and 0.100% or less,
V: 0.001% or more and 0.100% or less,
B: 0.0001% or more and 0.0100% or less,
Mo: 0.01% or more and 0.50% or less,
Cr: 0.01% or more and 1.00% or less,
Cu: 0.01% or more and 1.00% or less,
Ni: 0.01% or more and 0.50% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less, Zr: 0.001% or more and 0.020% or less, and REM: 0.0001% or more and 0.0200% or less.

10. The steel sheet according to claim 2, further comprising a coated layer disposed on a surface of the steel sheet.

11. The steel sheet according to claim 3, further comprising a coated layer disposed on a surface of the steel sheet.

12. The steel sheet according to claim 9, further comprising a coated layer disposed on a surface of the steel sheet.

13. A method for producing the steel sheet according to claim 9, the method comprising, in sequence:

heating steel;

performing hot rolling at a finish rolling entry temperature in a range of 1,020° C. or higher and 1,180° C. or lower and a finish rolling delivery temperature in a range of 800° C. or higher and 1,000° C. or lower;

performing coiling at a coiling temperature of 600° C. or lower;

performing cold rolling; and performing annealing by letting a temperature defined by formula (1) be temperature T1 (° C.) and letting a temperature defined by formula (2) be temperature T2 (° C.):

$$\text{temperature } T1(^\circ\text{C.})=960-203\times[\%\text{ C}]^{1/2}+45\times[\%\text{ Si}]-30\times[\%\text{ Mn}]+150\times[\%\text{ Al}]-20\times[\%\text{ Cu}]+11\times[\%\text{ Cr}]+400\times[\%\text{ Ti}] \quad (1)$$

where [% X] indicates the component element X content (% by mass) of steel and is 0 if X is not contained, and $$\text{temperature } T2(^\circ\text{C.})=560-566\times[\%\text{ C}]-150\times[\%\text{ C}]\times[\%\text{ Mn}]-7.5\times[\%\text{ Si}]+15\times[\%\text{ Cr}]-67.6\times[\%\text{ C}]\times[\%\text{ Cr}] \quad (2)$$

where [% X] indicates the component element X content (% by mass) of steel and is 0 if X is not contained, wherein the annealing includes, in sequence:

retaining heat at a heating temperature equal to or higher than temperature T1 for 10s or more, performing cooling to a cooling stop temperature in a range of 220° C. or higher and ((220° C.+temperature T2)/2) or lower, performing reheating from the cooling stop temperature to a reheating temperature of A or higher and 560° C. or lower, where A is a freely-selected temperature (° C.) that satisfies (temperature T2+20° C.)≤A≤530° C.) at an average heating rate of 10° C./s or more, and performing holding at the temperature A for 10s or more.

14. The method for producing the steel sheet according to claim 13, wherein a rolling reduction in a pass before a final pass of a finish rolling in the hot rolling is in a range of 15% or more and 25% or less.

15. The method for producing the steel sheet according to claim 13, wherein a heat treatment is performed after the coiling and before the cold rolling, and the heat treatment includes performing cooling from the coiling temperature to 200° C. or lower, performing reheating, and performing holding in a temperature range of 450° C. to 650° C. for 900s or more.

16. The method for producing the steel sheet according to claim 6, wherein a heat treatment is performed after the coiling and before the cold rolling, and the heat treatment includes performing cooling from the coiling temperature to 200° C. or lower, performing reheating, and performing holding in a temperature range of 450° C. to 650° C. for 900s or more.

17. The method for producing the steel sheet according to claim 14, wherein a heat treatment is performed after the coiling and before the cold rolling, and the heat treatment includes performing cooling from the coiling temperature to 200° C. or lower, performing reheating, and performing holding in a temperature range of 450° C. to 650° C. for 900s or more.

18. The method for producing the steel sheet according to claim 15, wherein a coating treatment is performed after the annealing.

19. The method for producing the steel sheet according to claim 16, wherein a coating treatment is performed after the annealing.

20. The method for producing the steel sheet according to claim 17, wherein a coating treatment is performed after the annealing.

* * * * *